US012336585B2

(12) United States Patent
Weber et al.

(10) Patent No.: US 12,336,585 B2
(45) **Date of Patent: *Jun. 24, 2025**

(54) OMNIDIRECTIONAL ENERGY MANAGEMENT SYSTEMS AND METHODS

(71) Applicant: 6D Helmets, LLC, Brea, CA (US)

(72) Inventors: Robert Weber, Fullerton, CA (US); Robert Daniel Reisinger, Newhall, CA (US)

(73) Assignee: 6D Helmets, LLC, Brea, CA (US)

( * ) Notice: Subject to any disclaimer, the term of this patent is extended or adjusted under 35 U.S.C. 154(b) by 113 days.

This patent is subject to a terminal disclaimer.

(21) Appl. No.: 17/722,249

(22) Filed: Apr. 15, 2022

(65) Prior Publication Data

US 2022/0322780 A1 Oct. 13, 2022

Related U.S. Application Data

(63) Continuation of application No. 17/086,290, filed on Oct. 30, 2020, now Pat. No. 11,766,085, which is a continuation-in-part of application No. 16/792,172, filed on Feb. 14, 2020, now abandoned, application No. 17/722,249 is a continuation of application No. 16/442,384, filed on Jun. 14, 2019, now Pat. No. 11,324,273, said application No. 17/086,290 is a continuation of application No. PCT/US2019/030072, filed on Apr. 30, 2019, said (Continued)

(51) Int. Cl.

| | |
|---|---|
| ***A42B 3/12*** | (2006.01) |
| ***A42B 3/06*** | (2006.01) |
| ***A42B 3/08*** | (2006.01) |
| ***A42B 3/20*** | (2006.01) |

(52) U.S. Cl.

CPC ..... *A42B 3/125* (2013.01); *A42B 3/063* (2013.01); *A42B 3/064* (2013.01); *A42B 3/08* (2013.01); *A42B 3/085* (2013.01); *A42B 3/205* (2013.01)

(58) Field of Classification Search

CPC ..... A42B 3/125; A42B 3/063; A42B 3/064

See application file for complete search history.

(56) References Cited

U.S. PATENT DOCUMENTS

| | | | | |
|---|---|---|---|---|
| 3,039,108 A | | 6/1962 | Lohrenz | |
| 3,153,242 A | * | 10/1964 | Nedwick | A42B 3/064 D29/106 |

(Continued)

FOREIGN PATENT DOCUMENTS

| | | |
|---|---|---|
| CA | 693175 | 8/1964 |
| CN | 1316207 | 10/2001 |

(Continued)

*Primary Examiner* — Khaled Annis

(74) *Attorney, Agent, or Firm* — Haynes and Boone, LLP

(57) ABSTRACT

Systems and methods of a safety helmet for protecting the human head against repetitive impacts, moderate impacts and severe impacts so as to significantly reduce the likelihood of both translational and rotational brain injury and concussions may be provided. The helmet may include an outer shell, an outer liner disposed within and coupled to the outer shell, and an inner liner disposed within and coupled in spaced opposition to the outer liner. A damper array may allow for omnidirectional movement of the inner liner relative to the outer liner and the outer shell.

20 Claims, 32 Drawing Sheets

Related U.S. Application Data application No. 16/792,172 is a continuation of application No. 15/186,418, filed on Jun. 17, 2016, now Pat. No. 10,561,192, said application No. 16/442,384 is a continuation-in-part of application No. 15/186,418, filed on Jun. 17, 2016, now Pat. No. 10,561,192, which is a continuation-in-part of application No. 14/607,004, filed on Jan. 27, 2015, now Pat. No. 9,820,525, which is a continuation of application No. 13/368,866, filed on Feb. 8, 2012, now Pat. No. 8,955,169.

(60) Provisional application No. 62/861,260, filed on Jun. 13, 2019, provisional application No. 62/685,895, filed on Jun. 15, 2018, provisional application No. 62/665,427, filed on May 1, 2018, provisional application No. 62/188,598, filed on Jul. 3, 2015, provisional application No. 62/181,121, filed on Jun. 17, 2015, provisional application No. 61/554,351, filed on Nov. 1, 2011, provisional application No. 61/462,914, filed on Feb. 9, 2011.

(56) References Cited

U.S. PATENT DOCUMENTS 3,413,656 A 12/1968 Vogllano et al.
3,872,511 A 3/1975 Nichols
3,877,076 A 4/1975 Summers et al.
4,012,794 A 3/1977 Nomiyama
4,024,586 A 5/1977 Lamb
4,064,565 A 12/1977 Griffiths
4,213,202 A 7/1980 Larry
4,290,149 A 9/1981 Aileo
4,307,471 A 12/1981 Lovell
4,345,338 A 8/1982 Frieder et al.
4,432,099 A 2/1984 Grick et al.
4,472,472 A 9/1984 Schultz
4,534,068 A 8/1985 Mitchell et al.
4,555,816 A 12/1985 Broersma
4,558,470 A 12/1985 Mitchell et al.
4,586,200 A 5/1986 Poon
4,627,114 A 12/1986 Mitchell
4,987,609 A 1/1991 Zahn
5,068,922 A 12/1991 Zahn
5,086,520 A 2/1992 Arai
5,129,107 A * 7/1992 Lorenzo ..... A42B 1/203 2/413
5,204,998 A 4/1993 Liu
5,309,576 A 5/1994 Broersma
5,581,819 A 12/1996 Garneau
5,619,756 A 4/1997 Garneau
5,669,079 A 9/1997 Morgan
5,815,846 A 10/1998 Calonge
5,833,796 A 11/1998 Matich
5,950,244 A 9/1999 Fournier et al.
5,956,777 A 9/1999 Popovich
5,978,972 A 11/1999 Stewart et al.
6,009,566 A 1/2000 Hubbard
6,052,835 A 4/2000 O'Shea
6,070,271 A 6/2000 Williams
6,070,905 A 6/2000 Renault
6,093,468 A 7/2000 Toms et al.
6,314,586 B1 11/2001 Duguid
6,378,140 B1 4/2002 Abraham et al.
6,401,260 B1 6/2002 Porth
6,418,564 B1 7/2002 Sheridan
6,453,476 B1 9/2002 Moore, III
6,536,052 B2 3/2003 Tao et al.
6,560,787 B2 5/2003 Mendoza
6,658,671 B1 12/2003 Von Holst et al.
6,711,751 B1 3/2004 Muskovitz
6,751,808 B2 6/2004 Puchalski
6,925,657 B2 8/2005 Takahashi et al.
6,931,669 B2 8/2005 Ashline
6,996,856 B2 2/2006 Puchalski
D521,191 S 5/2006 Berger
7,076,811 B2 7/2006 Puchalski
7,159,249 B2 1/2007 Dennis et al.
7,207,071 B2 4/2007 Pierce
7,299,505 B2 11/2007 Dennis et al.
7,328,462 B1 2/2008 Straus
7,376,981 B2 5/2008 Shida
7,574,754 B2 8/2009 Arai
7,676,854 B2 3/2010 Berger et al.
7,735,157 B2 6/2010 Ikeda
7,735,158 B2 6/2010 Tsurumi
7,748,059 B2 7/2010 Arai
7,802,320 B2 9/2010 Morgan
7,832,023 B2 11/2010 Crisco
7,895,681 B2 3/2011 Ferrara
7,930,771 B2 4/2011 Depreitere et al.
8,955,169 B2 * 2/2015 Weber ..... A42B 3/125 2/425
9,089,180 B2 7/2015 Phipps et al.
9,388,873 B1 7/2016 Phipps et al.
9,439,468 B1 * 9/2016 Blagg ..... A42B 3/125
9,439,469 B2 9/2016 Phipps et al.
9,549,582 B2 1/2017 Phipps et al.
9,879,741 B2 1/2018 Phipps et al.
10,010,126 B1 * 7/2018 Shaffer ..... A42B 3/064
10,029,633 B2 7/2018 Phipps et al.
10,306,942 B2 6/2019 Hoshizaki et al.
10,362,829 B2 * 7/2019 Lowe ..... A42B 3/064
10,660,390 B2 * 5/2020 Ku ..... A42B 3/064
11,678,709 B2 * 6/2023 Halldin ..... A42B 3/069 2/411
2001/0032351 A1 10/2001 Nakayama et al.
2002/0023291 A1 2/2002 Mendoza
2004/0117896 A1 6/2004 Madey et al.
2005/0246824 A1 11/2005 Berger et al.
2006/0059606 A1 3/2006 Ferrara
2006/0260026 A1 * 11/2006 Doria ..... A42B 3/127 2/414
2007/0190292 A1 8/2007 Ferrara
2007/0190293 A1 8/2007 Ferrara
2007/0000032 A1 9/2007 Morgan
2008/0155735 A1 7/2008 Ferrara
2008/0256686 A1 10/2008 Ferrara
2009/0038055 A1 2/2009 Ferrara
2009/0320185 A1 12/2009 Hassler
2010/0000009 A1 1/2010 Morgan
2010/0186150 A1 7/2010 Ferrara et al.
2010/0205722 A1 8/2010 Kim
2010/0258988 A1 10/2010 Darnell et al.
2010/0295221 A1 11/2010 Kilgerman et al.
2011/0047685 A1 3/2011 Ferrara
2012/0060251 A1 3/2012 Schimpf
2012/0139172 A1 6/2012 Hawkins et al.
2012/0151664 A1 6/2012 Kirshon
2012/0198604 A1 8/2012 Weber et al.
2013/0061371 A1 * 3/2013 Phipps ..... A42B 3/064 2/411
2013/0152281 A1 6/2013 Kravits et al.
2013/0185837 A1 * 7/2013 Phipps ..... A42B 3/0453 2/2.5
2013/0247284 A1 9/2013 Hoshizaki et al.
2013/0298316 A1 * 11/2013 Jacob ..... A42B 3/125 2/414
2014/0000012 A1 * 1/2014 Mustapha ..... H01F 7/02 2/414
2014/0013491 A1 1/2014 Hoshizaki et al.
2014/0109299 A1 * 4/2014 Kwan ..... A42B 3/121 2/455
2014/0208486 A1 * 7/2014 Krueger ..... A42B 3/064 2/414
2014/0345036 A1 11/2014 Sargenti et al.
2015/0089724 A1 * 4/2015 Berry ..... A42B 3/064 2/414
2015/0157082 A1 6/2015 Weber et al.
2015/0223547 A1 8/2015 Wibby
2015/0250248 A1 9/2015 Jacobsen

(56) References Cited

U.S. PATENT DOCUMENTS

| | | | | |
|---|---|---|---|---|
| 2015/0264991 | A1* | 9/2015 | Frey | A42B 3/064 2/411 |
| 2015/0305427 | A1* | 10/2015 | Prabhu | A42B 3/061 2/412 |
| 2016/0029730 | A1* | 2/2016 | Day | A42B 3/064 2/412 |
| 2016/0165993 | A1* | 6/2016 | Knight | A42B 3/124 2/455 |
| 2016/0316847 | A1* | 11/2016 | Weber | A42B 3/064 |
| 2017/0164678 | A1 | 6/2017 | Allen et al. | |
| 2017/0232327 | A1* | 8/2017 | Kuntz | A42B 3/125 2/413 |
| 2017/0273389 | A1 | 9/2017 | Muller | |
| 2017/0290388 | A1 | 10/2017 | Briggs | |
| 2017/0347741 | A1* | 12/2017 | Manera | A42B 3/063 |
| 2018/0000186 | A1* | 1/2018 | Brown | A42B 3/064 |
| 2018/0092422 | A1* | 4/2018 | Knight | A42B 3/08 |
| 2018/0132557 | A1* | 5/2018 | Torres | A42B 3/205 |
| 2018/0168268 | A1 | 6/2018 | Grinneback et al. | |
| 2018/0228239 | A1* | 8/2018 | Day | F16F 1/126 |
| 2019/0269193 | A1 | 9/2019 | Benyola et al. | |
| 2019/0297985 | A1* | 10/2019 | Weber | A42B 3/064 |
| 2019/0328073 | A1* | 10/2019 | Morgan | A42B 3/124 |
| 2019/0350295 | A1* | 11/2019 | Timlick | A42B 3/064 |
| 2020/0022444 | A1* | 1/2020 | Stone | A42B 3/065 |
| 2020/0037690 | A1 | 2/2020 | Pomering | |
| 2020/0146385 | A1* | 5/2020 | Young | A42B 3/064 |
| 2021/0045487 | A1* | 2/2021 | Weber | A42B 3/064 |
| 2022/0053866 | A1* | 2/2022 | Baker | A42B 3/064 |
| 2023/0225445 | A1* | 7/2023 | Seyffarth | A42B 3/064 2/414 |
| 2023/0397687 | A1* | 12/2023 | Chilson | A42B 3/06 |

FOREIGN PATENT DOCUMENTS

| | | |
|---|---|---|
| CN | 1997506 | 7/2007 |
| CN | 101827537 | 9/2010 |
| CN | 102406262 A | 4/2012 |
| CN | 103635112 A | 3/2014 |
| CN | 104244754 A | 12/2014 |
| EP | 1142495 | 10/2001 |
| EP | 2428129 | 3/2012 |
| EP | 2672853 | 12/2013 |
| WO | WO 2011/139224 | 11/2011 |

* cited by examiner

OMNIDIRECTIONAL ENERGY MANAGEMENT SYSTEMS AND METHODS

CROSS-REFERENCE TO RELATED APPLICATIONS

This application is a continuation of U.S. patent application Ser. No. 16/442,384, filed on Jun. 14, 2019 and entitled "OMNIDIRECTIONAL ENERGY MANAGEMENT SYSTEMS AND METHODS," which in turn claims the benefit of and priority to U.S. Provisional Patent Application No. 62/861,260, filed on Jun. 13, 2019 and entitled "OMNIDIRECTIONAL ENERGY MANAGEMENT SYSTEMS AND METHODS" and U.S. Provisional Patent Application No. 62/685,895, filed on Jun. 15, 2018 and entitled "OMNIDIRECTIONAL ENERGY MANAGEMENT SYSTEMS AND METHODS," all of which are incorporated herein by reference in their entirety.

U.S. patent application Ser. No. 16/442,384 is a continuation-in-part of U.S. patent application Ser. No. 15/186,418, filed on Jun. 17, 2016 and entitled "OMNIDIRECTIONAL ENERGY MANAGEMENT SYSTEMS AND METHODS," which is incorporated herein by reference in its entirety.

U.S. patent application Ser. No. 15/186,418 is a continuation-in-part of U.S. patent application Ser. No. 14/607,004, filed on Jan. 27, 2015 (now U.S. Pat. No. 9,820,525 issued Nov. 21, 2017) and entitled "HELMET OMNIDIRECTIONAL ENERGY MANAGEMENT SYSTEMS," and claims the benefit of and priority to U.S. Provisional Patent Application No. 62/181,121, filed on Jun. 17, 2015 and entitled "OMNIDIRECTIONAL ENERGY MANAGEMENT SYSTEMS AND METHODS," and U.S. Provisional Patent Application No. 62/188,598, filed on Jul. 3, 2015, entitled "OMNIDIRECTIONAL ENERGY MANAGEMENT SYSTEMS AND METHODS," all of which are incorporated herein by reference in their entirety.

U.S. patent application Ser. No. 14/607,004 is a continuation of U.S. patent application Ser. No. 13/368,866, filed Feb. 8, 2012 (now U.S. Pat. No. 8,955,169 issued Feb. 17, 2015) and entitled "HELMET OMNIDIRECTIONAL ENERGY MANAGEMENT SYSTEMS," which is incorporated herein by reference in its entirety.

U.S. patent application Ser. No. 13/368,866 claims the benefit of and priority to U.S. Provisional Patent Application No. 61/462,914, filed on Feb. 9, 2011 and entitled "HELMET OMNI-DIRECTIONAL ENERGY MANAGEMENT SYSTEM," and U.S. Provisional Patent Application No. 61/554,351, filed on Nov. 1, 2011 and entitled "HELMET OMNI-DIRECTIONAL ENERGY MANAGEMENT SYSTEM," all of which are incorporated herein by reference in their entirety.

This application is a continuation of U.S. patent application Ser. No. 17/086,290, filed on Oct. 30, 2020 and entitled "OMNIDIRECTIONAL ENERGY MANAGEMENT SYSTEMS AND METHODS," which in turn is a continuation of International Patent Application No. PCT/US2019/030072, filed on Apr. 30, 2019 and entitled "OMNIDIRECTIONAL ENERGY MANAGEMENT SYSTEMS AND METHODS," all of which are incorporated herein by reference in their entirety.

The International Patent Application No. PCT/US2019/030072, filed on Apr. 30, 2019 claims priority to and the benefit of U.S. Provisional Patent Application No. 62/665,427 filed May 1, 2018 and entitled "OMNIDIRECTIONAL ENERGY MANAGEMENT SYSTEMS AND METHODS," which is incorporated herein by reference in its entirety.

U.S. patent application Ser. No. 17/086,290 is a continuation-in-part of U.S. patent application Ser. No. 16/792,172 filed on Feb. 14, 2020, which is a continuation of U.S. patent application Ser. No. 15/186,418 filed on Jun. 17, 2016 (now U.S. Pat. No. 10,561,192 issued Feb. 18, 2020) and entitled "OMNIDIRECTIONAL ENERGY MANAGEMENT SYSTEMS AND METHODS," all of which are incorporated herein by reference in their entirety.

U.S. patent application Ser. No. 15/186,418 claims the benefit of and priority to U.S. Provisional Patent Application No. 62/181,121 filed on Jun. 17, 2015 and entitled "OMNIDIRECTIONAL ENERGY MANAGEMENT SYSTEMS AND METHODS" and U.S. Provisional Patent Application No. 62/188,598 filed on Jul. 3, 2015 and entitled "OMNIDIRECTIONAL ENERGY MANAGEMENT SYSTEMS AND METHODS," all of which are incorporated herein by reference in their entirety.

TECHNICAL FIELD

One or more embodiments of the present invention generally relate to safety equipment, and more particularly for example, to protective helmets that protect the human head against repetitive impacts, moderate impacts and severe impacts so as to significantly reduce the likelihood of both translational and rotational brain injury and concussions.

BACKGROUND

Action sports (e.g., skateboarding, snowboarding, bicycle motocross (BMX), downhill mountain biking, and the like), motorsports (e.g., off-road and on-road motorcycle riding and racing) and traditional contact sports (e.g., football and hockey) continue to grow at a significant pace throughout the world as each of these sports expands into wider participant demographics. While technology and sophisticated training regimes continue to improve the performance capabilities for such athletes/participants, the risk of injury attendant to these activities also increases. Current "state of the art" helmets are not keeping pace with the evolution of sports and the capabilities of athletes. At the same time, science is providing alarming data related to the traumatic effects of both repetitive but moderate, and severe impacts to the head. While concussions are at the forefront of current concerns, rotational brain injuries from the same concussive impacts are no less of a concern, and in fact, are potentially more troublesome.

SUMMARY

In accordance with one or more embodiments of the present disclosure, omnidirectional impact energy management systems are provided for protective helmets that can significantly reduce both rotational and linear forces generated from impacts to the helmets over a broad spectrum of energy levels.

The novel techniques, for one or more embodiments, enable the production of hard-shelled safety helmets that can provide a controlled internal omnidirectional relative displacement capability, including relative rotation and translation, between the internal components thereof. The systems enhance modern helmet designs for the improved safety and well-being of athletes and recreational participants in sporting activities in the event of any type of impact to the wearer's head. These designs specifically address, among other things, the management, control, and reduction of angular acceleration forces, while simultaneously reducing linear impact forces acting on the wearer's head during such impacts.

In accordance with an embodiment, a helmet may be provided. The helmet may include an outer shell, an outer liner disposed within and coupled to the outer shell, an inner liner disposed within and coupled to the outer liner, an aligner coupled to the outer liner and the inner liner and configured to position the outer liner relative to the inner liner, and a damper configured to allow omnidirectional movement of the inner liner relative to the outer liner and the outer shell.

The scope of this invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly, and within which like reference numerals are used to identify like elements illustrated in one or more of the figures thereof.

DETAILED DESCRIPTION

In accordance with one or more embodiments of this disclosure, omnidirectional impact energy management systems for helmets are provided that can significantly reduce both rotational and linear forces generated from impacts imparted to the helmets. The systems enable a controlled internal omnidirectional relative displacement capability, including relative rotational and translational movement, between the internal components of a hard shelled safety helmet.

One or more embodiments disclosed herein are particularly well suited to helmets that can provide improved protection from both potentially catastrophic impacts and repetitive impacts of varying force that, while not causing acute brain injury, can cause cumulative harm. The problem of cumulative brain injury, i.e., Second Impact Syndrome (SIS), is increasingly recognized as a serious problem in certain sports, such as American football, where much of the force of non-catastrophic contact is transferred to the head of the wearer. In various example embodiments, helmets are configured with dampers of specific flex and compression characteristics to manage a wide range of repetitive and severe impacts from all directions, thus addressing the multitude of different risks associated with diverse sports, such as football, baseball, bicycle riding, motorcycle riding, skateboarding, rock climbing, hockey, snowboarding, snow skiing, auto racing, and the like.

Head injuries result from two types of mechanical forces—contact and non-contact. Contact injuries arise when the head strikes or is struck by another object. Non-contact injuries are occasioned by cranial accelerations or decelerations caused by forces acting on the head other than through contact with another object, such as whiplash-induced forces. Two types of cranial acceleration are recognized, which can act separately or in combination with each other. "Translational" acceleration occurs when the brain's center of gravity (CG), located approximately at the pineal gland, moves in a generally straight line. "Rotational" or angular acceleration occurs when the head turns about its CG without linear movement of the CG.

Translational accelerations/decelerations can result in so-called "coup" and "contrecoup" head injuries that respectively occur directly under the site of impact with an object and on the side of the head opposite the area that was impacted. By contrast, studies of the biomechanics of brain injury have established that forces applied to the head which result in a rotation of the brain about its CG cause diffuse brain injuries. It is this type of movement that is responsible for subdural hematomas and diffuse axonal injury (DAI), one of the most devastating types of traumatic brain injury.

Figure 1:
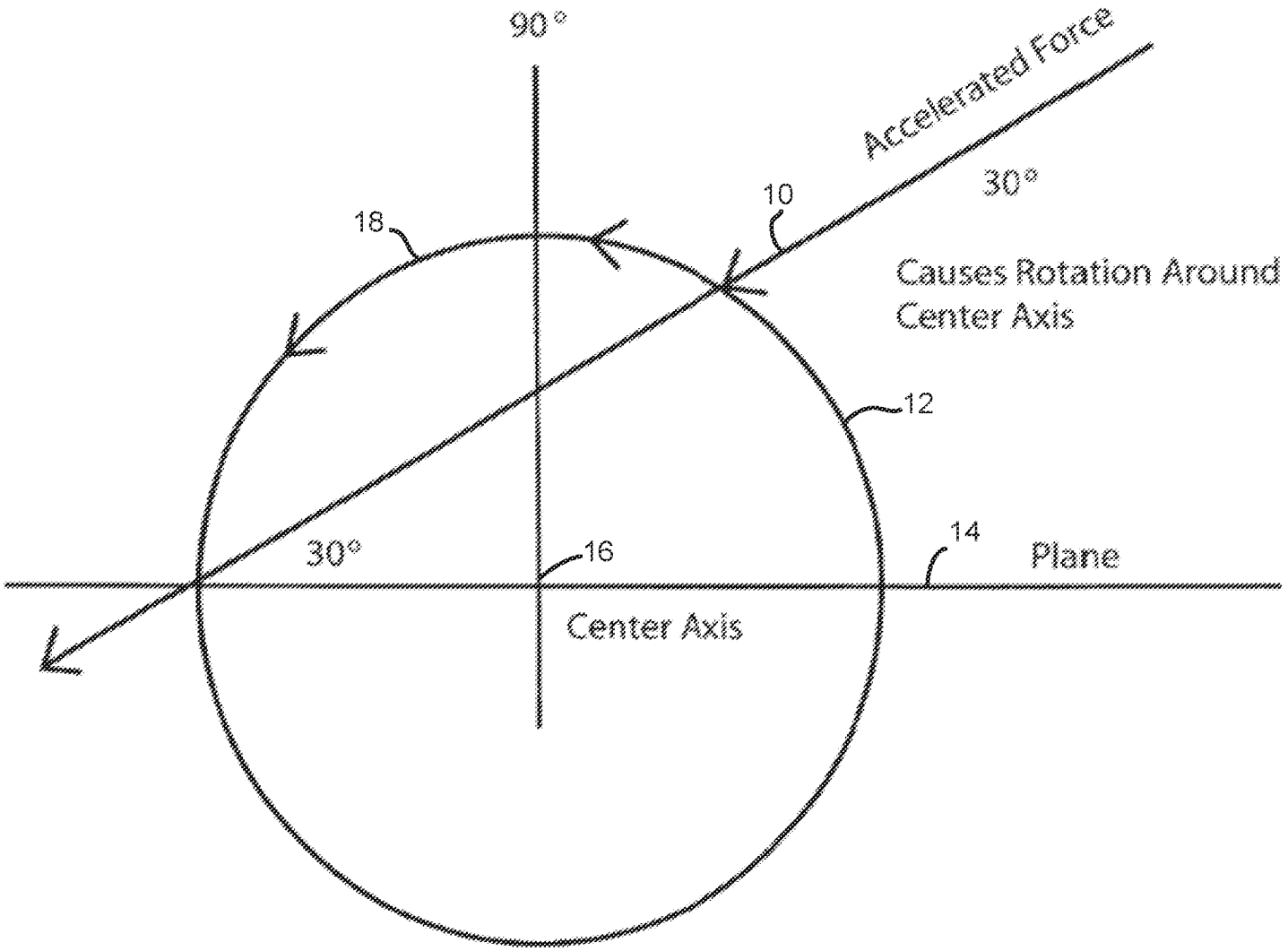
FIG. 1 is a diagram of an impact force acting on the head or helmet of a wearer so as to cause rotational acceleration of the wearer's brain around the brain's center of gravity.

Referring to FIG. 1, the risk of rotational brain injury is greatest when an impact force 10 is applied to the head or helmet 12 of a wearer from at an oblique angle, i.e., greater or less than 90 degrees to a perpendicular plane 14 drawn through the CG 16 of the brain. Such impacts cause rotational acceleration 18 of the brain around CG, potentially shearing brain tissue and causing DAI. However, given the distribution of brain matter, even direct linear or translational impacts can generate shear forces within the brain sufficient to cause rotational brain injuries. Angular acceleration forces can become greater, depending on the severity (i.e., force) of the impact, the degree of separation of the impact force 10 from 90 degrees to the perpendicular plane 14, and the type of protective device, if any, that the affected individual is wearing. Rotational brain injuries can be serious, long lasting, and potentially life threatening.

Safety helmets generally use relatively hard exterior shells and relatively soft, flexible, compressible interior padding, e.g., fit padding, foam padding, air filled bladders, or other structures, to manage impact forces. When the force applied to the helmet exceeds the capability of the combined resources of the helmet to reduce impacts, energy is transferred to the head and brain of the user. This can result in moderate concussion or severe brain injury, including a rotational brain injury, depending on the magnitude of the impact energy.

Safety helmets are designed to absorb and dissipate as much energy as possible over the greatest amount of time possible. Whether the impact causes direct linear or translational acceleration/deceleration forces or angular acceleration/deceleration forces, the helmet should eliminate or substantially reduce the amount of energy transmitted to the user's head and brain.

Figure 2:
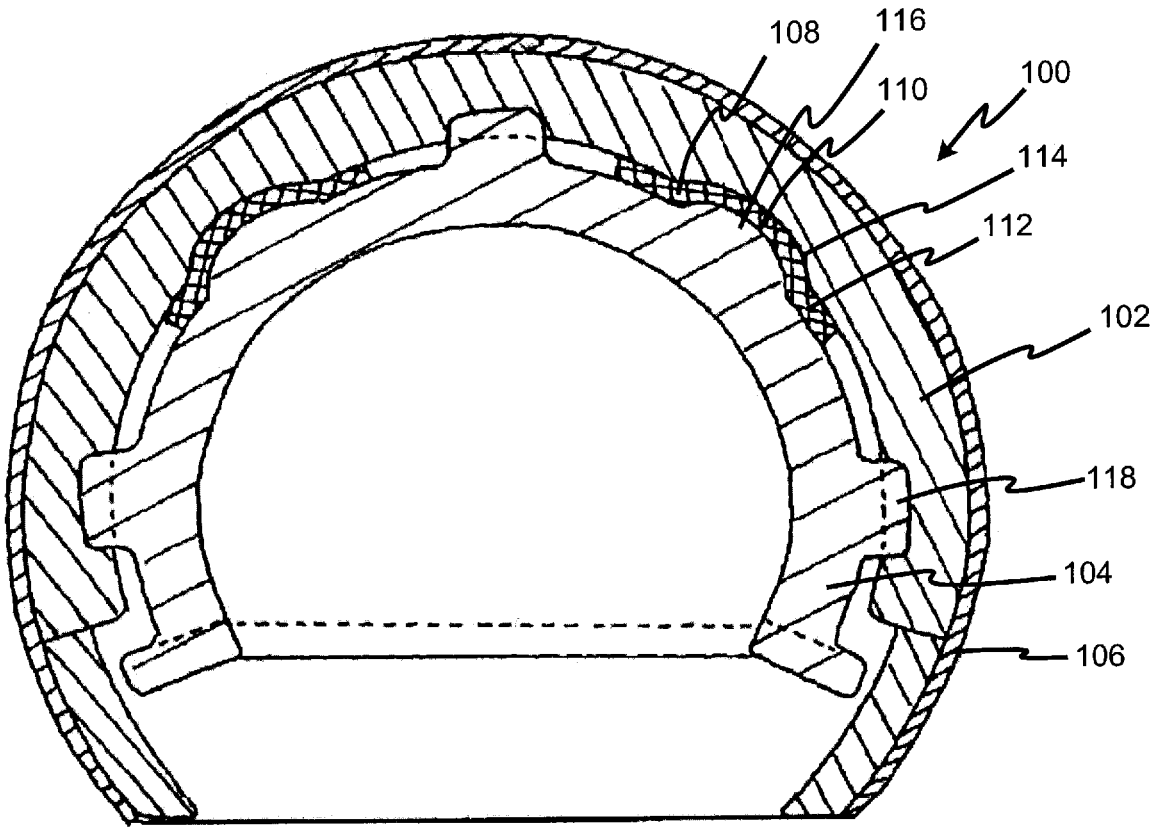
FIG. 2 is a cross-sectional view of an example of a helmet, taken at the coronal plane thereof in accordance with an embodiment.

FIG. 2 is a cross-sectional view of an example of a helmet, taken at the coronal plane thereof, in accordance with an embodiment. FIG. 2 is a partial cross-sectional view taken at the coronal plane of an example embodiment of a helmet 100, which includes a hollow, semispheroidal outer liner 102 disposed circumferentially around a similarly shaped inner liner 104 and inside of a correspondingly shaped, relatively hard helmet outer shell 106. In the particular example embodiment illustrated, the outer liner 102 is attached directly to the inside surface of the helmet shell 106, as is typical in conventional helmet design. The relatively hard outer shell 106 can be manufactured from conventional materials, such as fiber-resin lay-up type materials, polycarbonate plastics, polyurethane, or any other appropriate materials, depending on the specific application intended for the helmet 100.

The inner and outer liners 104 and 102 are coupled to each other so as to form an internal subassembly by the use of a plurality of resilient, e.g., elastomeric, structures referred to herein as "isolation dampers." As illustrated in FIG. 2, the isolation dampers 108 can comprise a generally circular disk having a concave, e.g., generally spherical, recess 110 disposed in a lower surface thereof, a correspondingly shaped convex protrusion extending from an upper surface thereof, and a flange 112 extending around the circumfery thereof. The inner liner 104 can include a plurality of convex, e.g., generally spherical, protrusions 116, each disposed in spaced opposition to a corresponding one of a plurality of correspondingly shaped concave recesses 114 disposed in the outer liner 102.

In an embodiment, one or both of the concave and convex features of the isolation dampers 108 can be complementary in shape to one or both of those of the concave and convex features of the inner and outer liners 104 and 102, respectively. The isolation dampers 108 are disposed between the inner and outer liners 104 and 102 such that their concave recesses 110 are respectively disposed over a corresponding one of the convex protrusions 116 on the inner liner 104, and the convex protrusions on the isolation dampers 108 are respectively disposed within corresponding ones of the concave recesses 114 in the outer liner 102.

Figure 3:
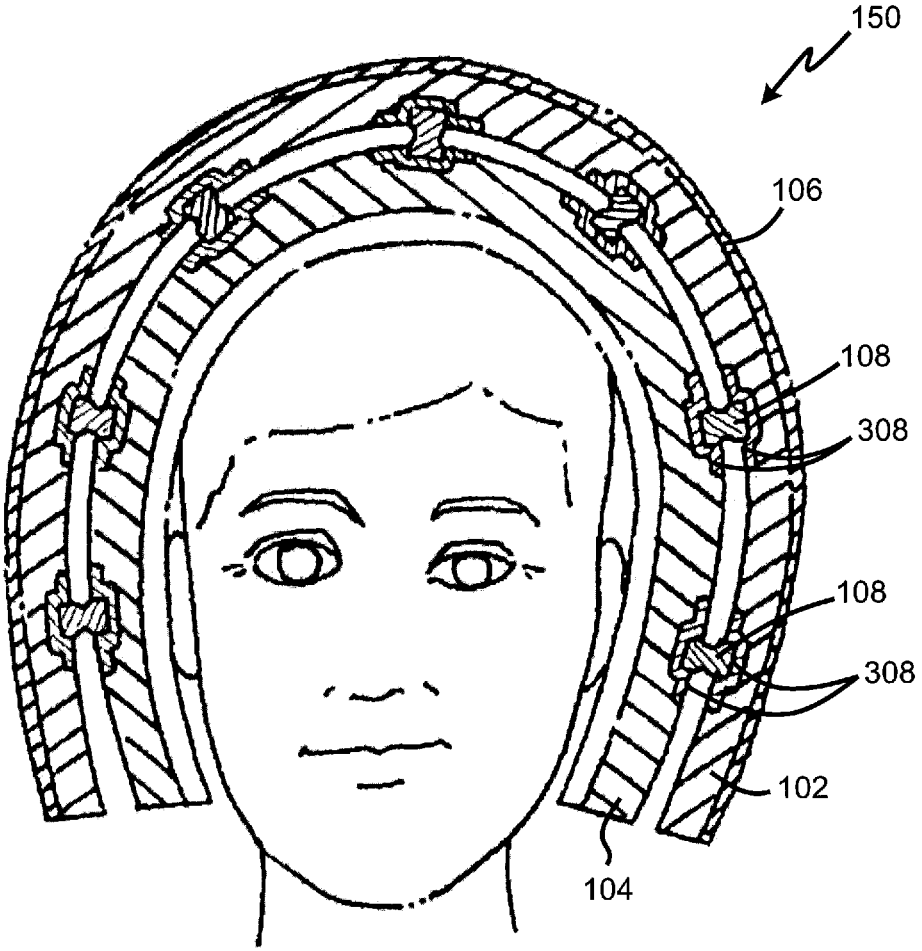
FIG. 3 is a cross-sectional view of another example helmet, taken at the coronal plane, showing a wearer's head disposed therein in accordance with an embodiment.

FIG. 3 is a cross-sectional view of another example helmet, taken at the coronal plane, showing a wearer's head disposed therein, in accordance with an embodiment. The helmet 150 of FIG. 2, includes an outer liner 102 disposed circumferentially around an inner liner 104, and both liners 104, 102 are disposed inside of a correspondingly shaped, relatively hard helmet shell 106. As in the helmet 100 of FIG. 2, the outer liner 102 is affixed directly to the inside surface of the outer shell 106, and the inner liner 104 is coupled to the outer liner 104 by a plurality of isolation dampers 108 for omnidirectional movement relative thereto. However, as illustrated in FIG. 3, in some embodiments, the isolation dampers 108 can comprise elongated cylindrical members having opposite ends respectively retained within isolation damper retainer cups, or inserts 308, respectively attached to corresponding ones of the inner and outer liners 104 and 102. As discussed in more detail below, the inserts 308 can comprise a variety of different materials and configurations and can be attached to the corresponding liners 102, 104 by a variety of attachment techniques.

As illustrated in FIGS. 2 and 3, plurality of the isolation dampers 108 can be provided at selected points around the circumfery of the helmets 100 or 150. Different isolation dampers 108 can be designed for specific applications and effectively "tuned" to manage the anticipated rotational and translational forces applied thereto. The isolation dampers 108 can be variously configured to control the amount of rotational force that will cause displacement of the various liners of the helmet 100 and, as discussed in more detail below, can be configured such that they will tend to cause the inner liner 104 to return to its original position relative to the outer liner 102 after the force of an impact is removed from the helmet 100 or 150. It will be readily apparent to those skilled in the art that isolation dampers 108 can be configured in a wide range of configurations and materials varying from those shown and described in the example embodiments, and the general principles described herein can be applied without departing from the spirit and scope of the invention.

In some embodiments, limits or "stops" can be designed into and between the liners to prevent over-rotation or over-displacement between the layers during an impact incident. Referring again to FIG. 2, in one embodiment, the inner liner 104 can be provided with multiple flanges 118 extending outward from the inner liner 104 to act as rotational stops by impacting with an edge of a corresponding recess in the outer liner 102 at maximum displacement. Other embodiments can use features of the helmet's exterior shell 106, a "comfort" liner (not illustrated), or perimeter moldings (not illustrated) to act as stops.

Figure 4:
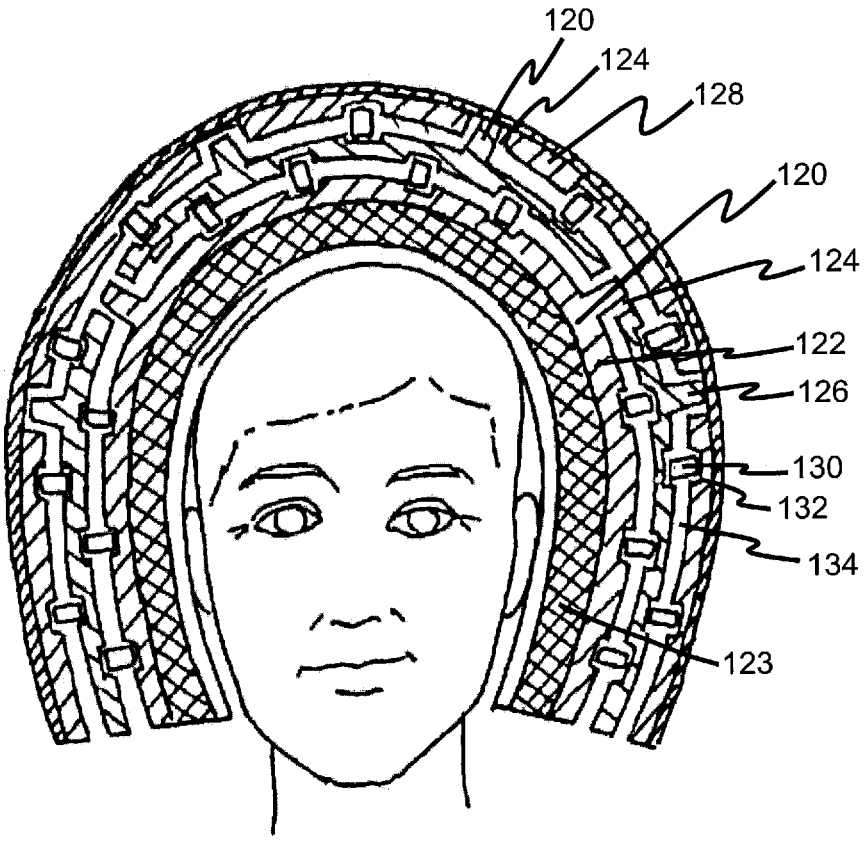
FIG. 4 is a cross-sectional view of another example helmet, taken at the coronal plane, showing a wearer's head disposed therein in accordance with an embodiment.

In other embodiments, one or more additional layers or liners can be inserted between an inner liner and outer liner. Such "intermediate" liners can be formed of, for example, EPS, EPP, EPU, or any other suitable materials. For example, as illustrated in FIG. 4, in an example embodiment, a plurality of lugs 120 can extend from an outer surface of the inner liner 122 to engage in corresponding recesses 124 disposed in an intermediate liner 126, while similar lugs 120 can extend from the middle layer 126 to engage in corresponding recesses 124 in an outer liner 128. These lugs 120 and corresponding recesses 124 can be configured to allow for a controlled amount of rotational movement between the intermediate 126 and the inner and outer liners 122 and 128. Optionally, in some embodiments, isolation dampers 130 of various configurations can also be disposed between, e.g., the inner and outer liners 122 and 128 and/or the intermediate liner 126 to further dissipate the energy of impacts. Additionally, as illustrated in FIG. 4, in some embodiments, a "comfort" liner 123 configured to closely surround the head of the wearer can be attached or otherwise coupled to an inner surface of the inner liner 122.

FIG. 4 is a cross-sectional view of another example helmet, taken at the coronal plane, showing a wearer's head disposed therein, in accordance with an embodiment. As further illustrated in FIG. 4, in some embodiments, the isolation dampers 130 can be cylindrical in shape, and configured such that they engage within corresponding recesses 132 in the adjacent surfaces of the inner, intermediate and outer liners 122, 126 and 128 so as to create a space or air gap 134 between the respective opposing surfaces thereof. The isolation dampers 130 can be configured to flex, bend, and/or compress to absorb the energy of impacts to the helmet from all directions, and thereby enable the inner and intermediate liners 122 and 126 to move relative to each other and/or the outer liner 128.

Figure 5:
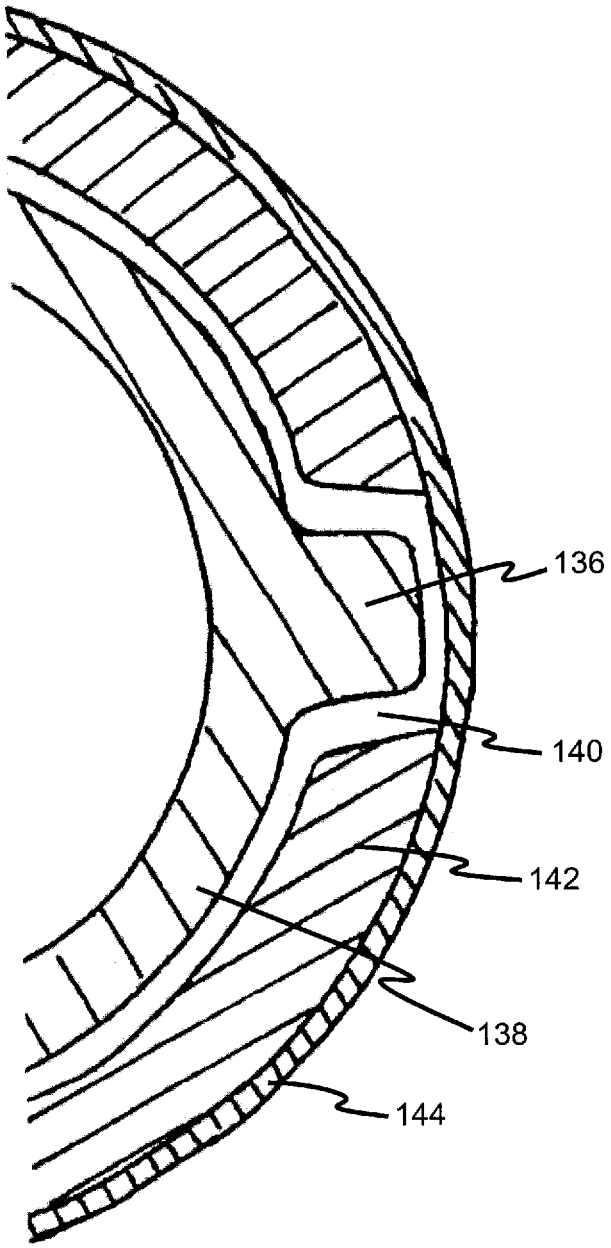
FIG. 5 is an enlarged partial cross-sectional view of another example helmet, showing a lug on an inner liner thereof engaged in a recess in an outer liner thereof in accordance with an embodiment.
Figure 6:
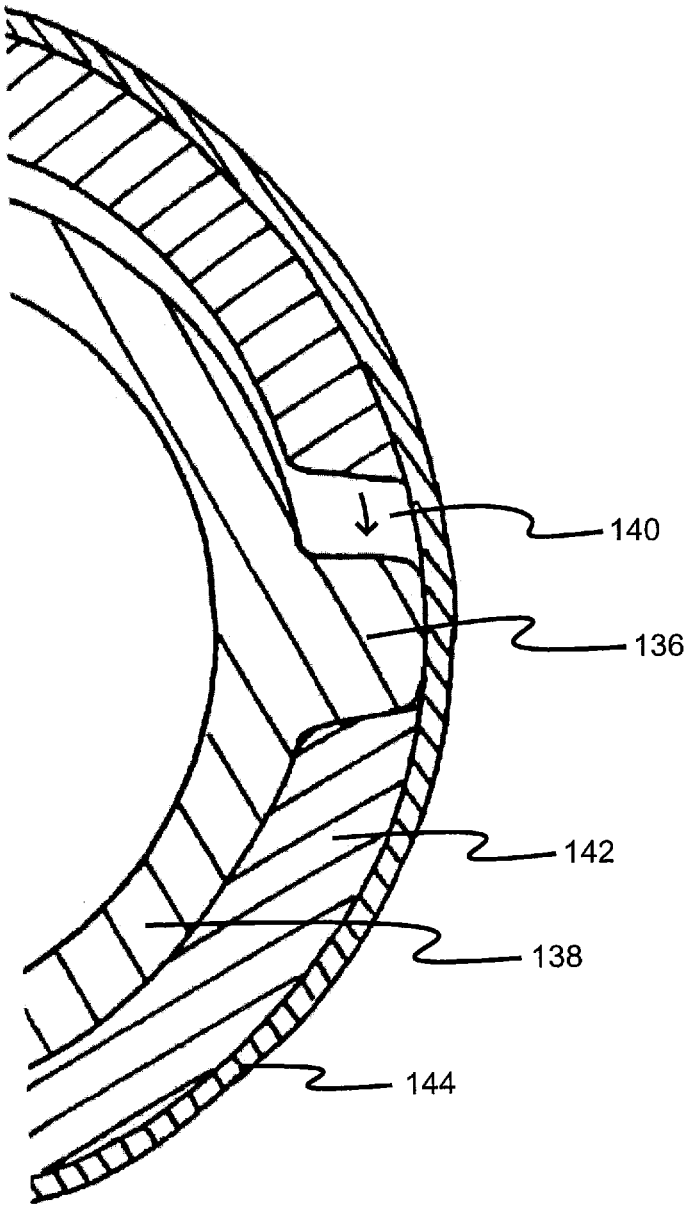
FIG. 6 is an enlarged partial cross-sectional view of the helmet of FIG. 5 showing displacement of the lug within the recess in response to a rotation of the inner liner relative to the outer liner, in accordance with an embodiment.

FIG. 5 is an enlarged partial cross-sectional view of another example helmet, showing a lug on an inner liner thereof engaged in a recess in an outer liner thereof, in accordance with an embodiment. FIG. 6 is an enlarged partial cross-sectional view of the helmet of FIG. 5, showing displacement of the lug within the recess in response to a rotation of the inner liner relative to the outer liner, in accordance with an embodiment.

As illustrated in FIGS. 5 and 6, in another embodiment, one or more lugs 136 can be disposed on the outer surface of an inner liner 138 so as to respectively engage within corresponding recesses 140 in an outer liner 142 attached internally to a helmet outer shell 144. The one or more recess 140 can be configured to allow for controlled lateral or rotational displacement of the inner liner 138 such that, once the inner liner 138 moves a predetermined distance relative to the outer liner 142, as indicated by the arrow in FIG. 5, the lug 136 will abut or engage one or more of the walls of the corresponding recess 140, thereby stopping movement of the inner liner 138 relative to the outer liner 142 in that direction. The amount of rotation between the liners can also be controlled without the use of interlocking lugs 136, for example, by configuring the gap between the two liners to be other than spherical, e.g., by conforming it to an oblong shape like that of the wearer's head. This non-spherical shape will geometrically bind during rotation due to the contact of impingement points within the structure and thereby limit rotation.

In other embodiments, a similar system of lugs 136 and isolation dampers 130 can be implemented using only two layers or liners 138, 142, or alternatively, using three or more liners. It will be readily understood by those of skill in the art that a wide range of different configurations can be devised for the lugs 136 and isolation dampers 130 described herein. Indeed, the lugs 136 and isolation dampers 130 can take on a wide range of shapes, sizes, materials, and specific physical properties. They can also be configured to engage different layers differently than as illustrated and described herein.

In some embodiments, the isolation dampers 130 can be configured with specific physical properties that enable them to couple an inner liner 138 with an outer layer 142 and maintain a predetermined gap there between, or otherwise control the spatial relationship between the two liners 138, 142. Where a space is maintained between different layers, the space can comprise an air gap, or can be completely or partially filled with any suitable material in any form, including without limitation, a liquid, gel, foam, or gas cushion.

As illustrated in, e.g., FIG. 3, in some embodiments, the isolation dampers 108 can comprise elongated cylindrical features having opposite ends that can be fitted into corresponding recesses or passages in the inner and outer liners 104, 102. The isolation dampers 108 can be made of, for example, rubber, EPU foam, or any other suitable materials that have the specific design characteristics desired in a particular application. The isolation dampers 108 can be held in place by a friction fit or a wide range of adhesives, or alternatively, other methods of attachment can be used, depending on the specific application at hand. The isolation dampers 10 enable the inner, outer and one or more intermediate layers, if any, to move omni-directionally relative to one another, including an inner liner 104 that is in a snug, direct contact with a wearer's head most commonly via a comfort liner.

As described above, in some embodiments, the isolation dampers 108 are configured so as to return the inner and outer liners 104 and 102 back to their respective initial or "neutral" resting positions relative to each other, once the rotational or translational force of an impact is removed from them. Thus, the outer shell 144 and internal liners of a helmet incorporating such an arrangement will quickly and automatically re-align themselves relative to each other after an impact. In this regard, it should be understood that the dimensions, shape, positioning, alignment, and materials of the isolation dampers 130 can be varied widely to tune the helmet to the specific application at hand.

Figure 7A:
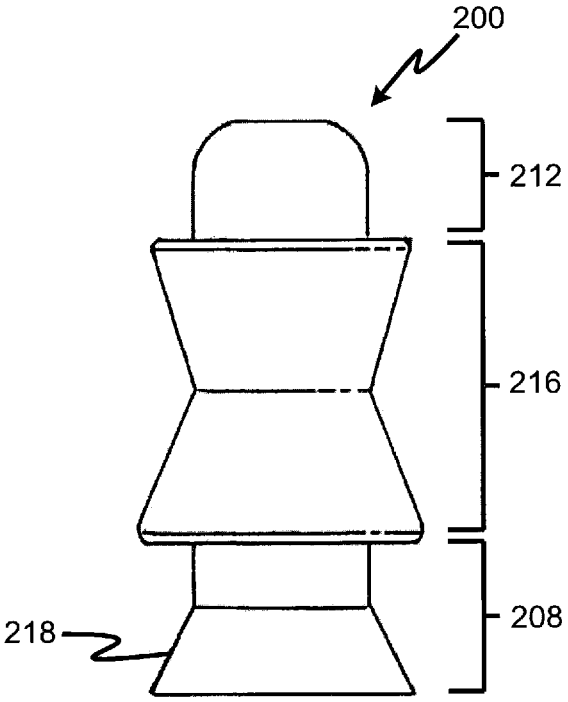
FIGS. 7A and 7B are side elevation and top end perspective views of an example of an isolation damper in accordance with the present invention in accordance with an embodiment.
Figure 7B:
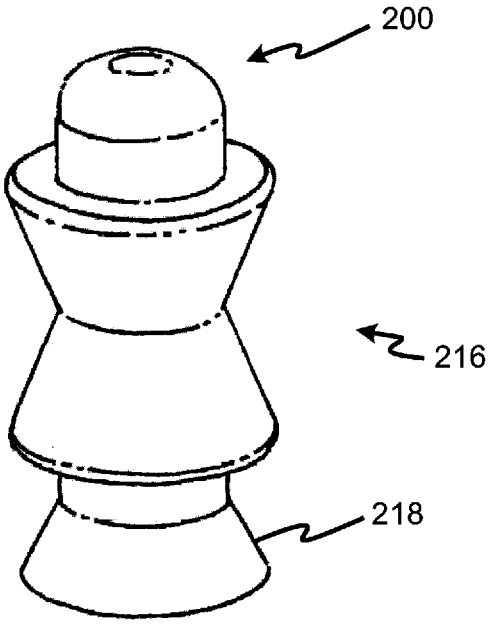

FIGS. 7A and 7B are side elevation and top end perspective views of an example of an isolation damper in accordance with the present invention, in accordance with an embodiment. As illustrated in FIGS. 7A and 7B, in some embodiments, the lower end portion 208 of the example isolation damper 200 is configured with a frusto-conical shape 218 to help ensure that it is securely coupled to the inner liner 202. The middle section 216 of the isolation damper 200 can be configured in the shape of, for example, an hourglass, to provide specific flex, return, and force dispersion characteristics. In particular, such an hourglass shape can enhance the ability of the isolation damper 200 to absorb much of the energy of light-to-moderate impacts without damaging the inner and outer liners 202 and 204, and as discussed above, to return the liners 202, 204 to their original relative positions afterward.

Figure 8:
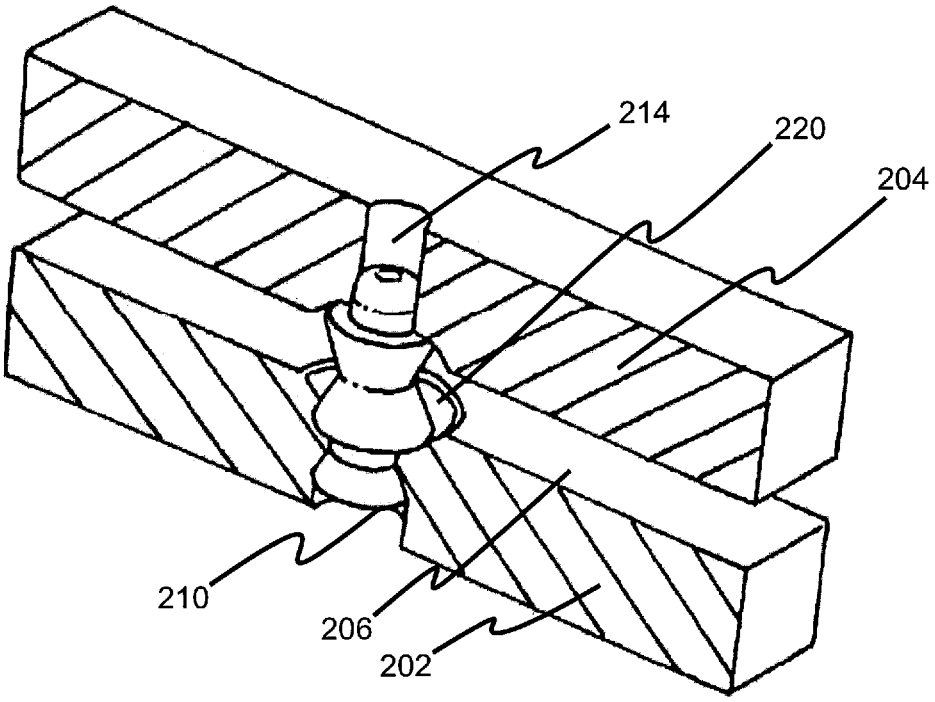
FIG. 8 is a partial cross-sectional view showing the isolation damper of FIGS. 7A and 7B coupled between an inner and an outer liner of a helmet in accordance with an embodiment.

FIG. 8 is a partial cross-sectional view showing the isolation damper of FIGS. 7A and 7B coupled between an inner and an outer liner of a helmet in accordance with an embodiment. In some embodiments, the apertures or recesses 210, 214 in the corresponding inner and outer liners 202 and 204 used to respectively retain the opposite ends 208 and 212 of the isolation dampers 200 can include specific geometries to manage the interaction between the isolation dampers 200 and the liners 202 and 204. For example, as illustrated in FIG. 8, in one embodiment, opposing frusto-conical recesses 220 can be disposed in the opposing surfaces of the liners 202 and 204 to allow the isolation damper 200 to move with a greater range of movement and to improve its stability. Specifically, the opposing frusto-conical recesses 220 provide a space for the isolation damper 200 to occupy during a deformation caused by, for example, a shearing type of impact. The respective geometries of the recesses 220 thus help to control the deformation, manage the spring rate, and constrain the shape of the corresponding isolation damper 200.

As those of some skill will understand, the specific shape and material properties of an isolation damper 200 are the primary control elements that affect its spring rate. As the geometry and/or material specifications of the isolation damper 200 are changed, the associated spring rate will change accordingly, following basic physical property relationships. For example, if only the length is increased, the spring rate will decrease, and the isolation damper 200 will become less resistant, in force per displacement, over a particular range of values. Further, if the geometric shape of the isolation damper is changed from one shape to another, for example, from a cylinder to an hourglass shape, the spring rate of the isolation damper 200 in axial compression versus its spring rate in a direction orthogonal to the direction of the axial compression can be altered and significantly changed to effect the desired performance requirements.

In addition to the physical shape of the isolation damper 200 and its material properties, the method by which the isolation damper 200 is constrained and allowed to deform, or prevented from deforming, is another design technique that can be used to control the dynamic interactions of an impact force acting on a helmet and how it is transferred from one liner to another liner. The opposing frusto-conical recesses 220 in opposing faces of the liners 202 and/or 204 described above are only one technique by which the dynamic movement characteristics of the isolation dampers 200 can be managed to control and modify the ability of the outer liner 204 to move in a desired fashion in both compression and shear directions relative to the inner layer 202.

If the volume of the isolation damper 200 cannot be reduced to zero, it must be displaced into another volume when it is compressed. If the spring rate of the isolation damper 200 is a function of its material properties and its ratio of compressibility into itself, then its spring rate will be nonlinear and will increase at an increasing rate. This increasing spring rate will grow as the isolation damper 200 is compressed and deformed, until it can no longer deform freely, at which time, the spring rate of the isolation damper 200 will increase rapidly such that it becomes virtually incompressible and exhibits an almost infinite resistance thereto. The frusto-conical recesses 200 in each liner 202, 204 at the respective attachment points of the isolation dampers 200 can be used to optimize these desired functions of movement in linear compression, shear movement and the point of contact of one liner with another liner by their geometric relationships to those of the associated isolation dampers 200, and also reducing the damage to the outer and inner liners that would be imposed onto them by the dampers as an additional control element.

Figure 9A:
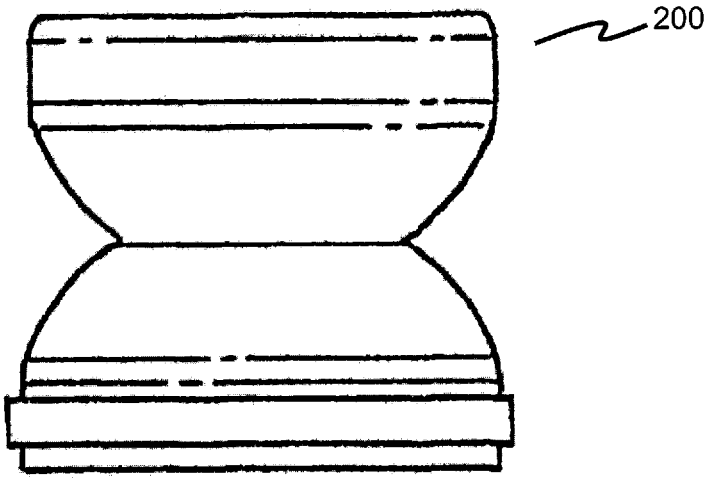
FIGS. 9A and 9B are side elevation views of other examples of isolation dampers in accordance with an embodiment of the present invention.
Figure 9B:
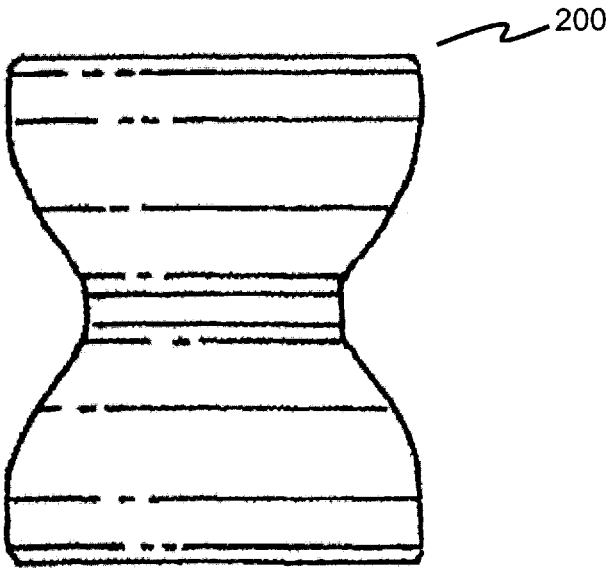

FIGS. 9A and 9B are side elevation views of other examples of isolation dampers in accordance with an embodiment of the present invention. The specific configurations, spacing, and quantity of the isolation dampers 200 can also be modified to obtain particular helmet impact absorbing characteristics suitable for the specific application at hand. Other example embodiments of isolation damper 200 may be illustrated in FIGS. 9A and 9B.

Figure 10:
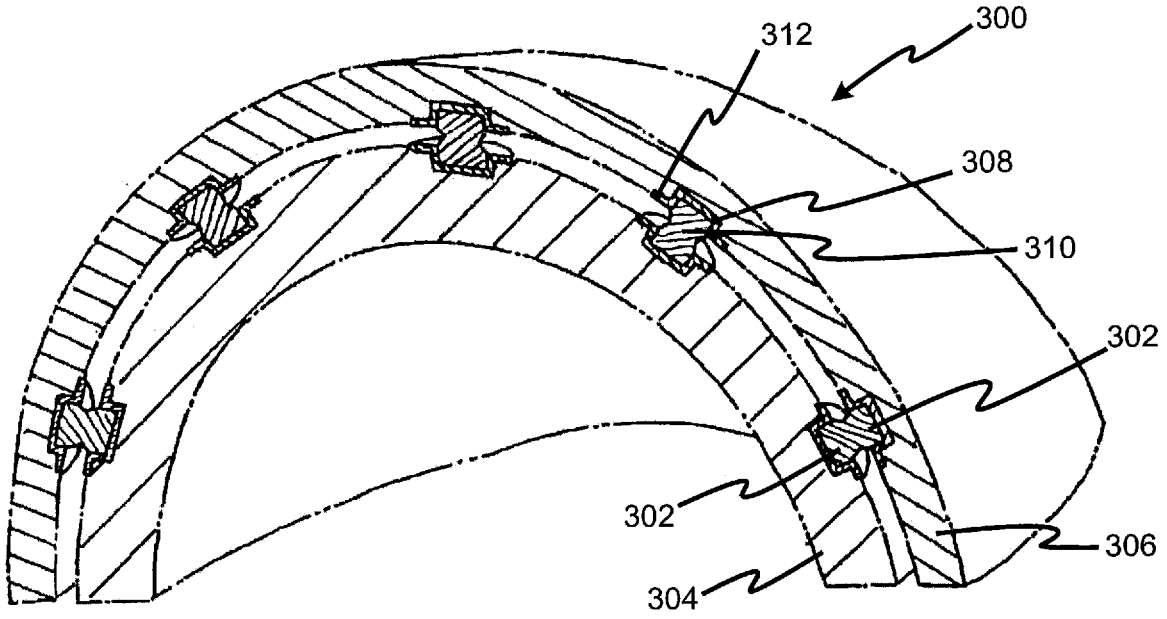
FIG. 10 is a partial cross-sectional view through another example helmet with inner and an outer liners, showing inserts respectively disposed in the liners and isolation dampers retained in the inserts in accordance with an embodiment.

FIG. 10 is a partial cross-sectional view through another example helmet with inner and outer liners, showing inserts respectively disposed in the liners and isolation dampers retained in the inserts, in accordance with an embodiment. As discussed above in connection with the example helmet embodiment of FIG. 3 above and illustrated in FIG. 10, in some embodiments, the recesses or apertures in the inner and outer liners 304 and 306 of the helmet 300 within which the opposite ends of the isolation dampers 310 are respectively received can be respectively fitted with inserts or cup-like inserts 308 that locate and retain the isolation dampers 310 in place, provide additional support for the isolation dampers 310 within the liners 304, 306, and help to manage and disburse impact forces acting on the helmet 300. The inserts 308 can be configured with any suitable geometry and can include flanges 312 of appropriate sizes and/or shapes to distribute forces over a larger area of a corresponding one of the liners 304, 306.

Figure 11A:
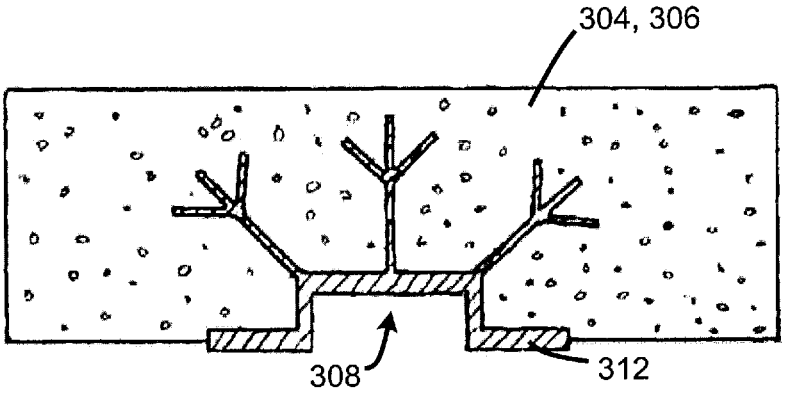
FIG. 11A is a partial cross-sectional view of a helmet liner, showing another example of an insert for retaining an end of an isolation damper molded therein in accordance with an embodiment.
Figure 11B:
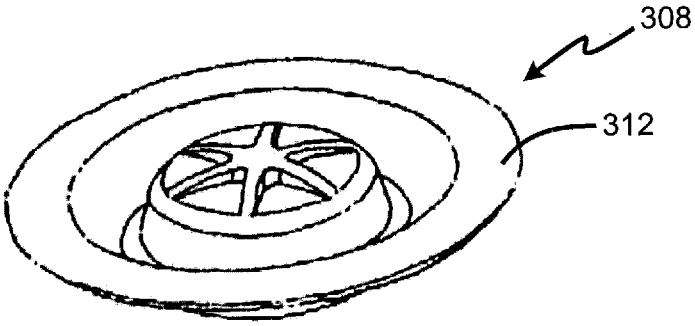
FIGS. 11B and 11C are top and side perspective view of another example of an isolation damper end retaining insert in accordance with an embodiment.
Figure 11C:
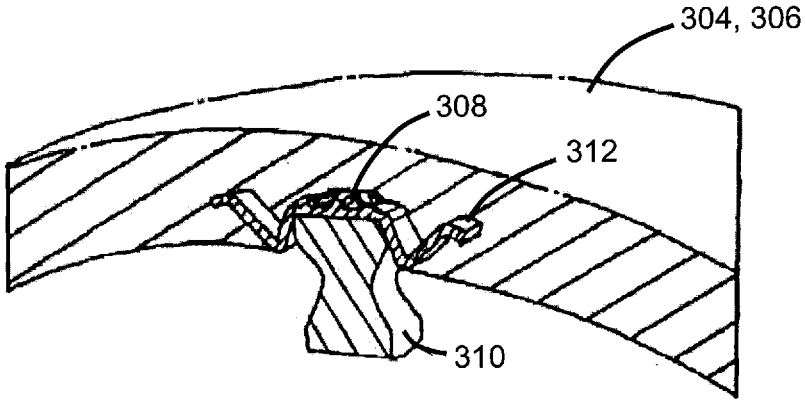

FIG. 11A is a partial cross-sectional view of a helmet liner, showing another example of an insert for retaining an end of an isolation damper molded therein, in accordance with an embodiment. FIGS. 11B and 11C are top and side perspective view of another example of an isolation damper end retaining insert, in accordance with an embodiment. As illustrated in FIG. 11A, in some embodiments, the inserts 308 respectively disposed on the inner and/or outer liners 304 and/or 306 can be over-molded into the associated liner 304 or 306 for attachment purposes, and as illustrated in the example embodiment of FIGS. 11B and 11C, can utilize the circumferential flange 312 in various sizes and configurations to help retain and distribute forces within the material of the associated liner 304 or 306.

The inserts 308 can be held in the associated liner 304 or 306 by, for example, friction, or alternatively, by any other suitable means, including adhesives, heat bonding and/or welding, and similarly, the respective ends of the isolation dampers 310 can held in the corresponding inserts 308 by friction, or alternatively, be fixed in the inserts 308 by any suitable method or means. The inserts 308 can be made of any suitable material, including thermosetting or thermoforming plastics, such as acrylonitrile butadiene styrene (ABS), polyvinylchloride (PVC), polyurethane (PU), polycarbonates, nylon, various alloys of metals, and the like.

Similarly, the isolation dampers 200 can be formed of a wide variety of elastomeric materials, including MCU (micro-cellular urethane), EPU, natural rubber, synthetic rubbers, foamed elastomers of various chemical constituents, solid cast elastomers of various chemical constituents, encased liquids, gels or gasses providing flexible structures, and any flexible assembly of any other kind that will provide the desired degree of omnidirectional movement.

The specific thicknesses of the various liners and gaps, if any, between them can be varied widely depending on the particular application of the helmet. The geometries and relative arrangement of the various liners and any gaps between them can also be varied to manage the characteristics of the helmet in response to impacts from a range of different directions and magnitudes. For example, in one specific example embodiment, inner and outer EPS liners with respective thicknesses of about twenty (20) millimeters and twelve (12) millimeters can be used with an air gap of about six (6) millimeter between them.

Figure 12:
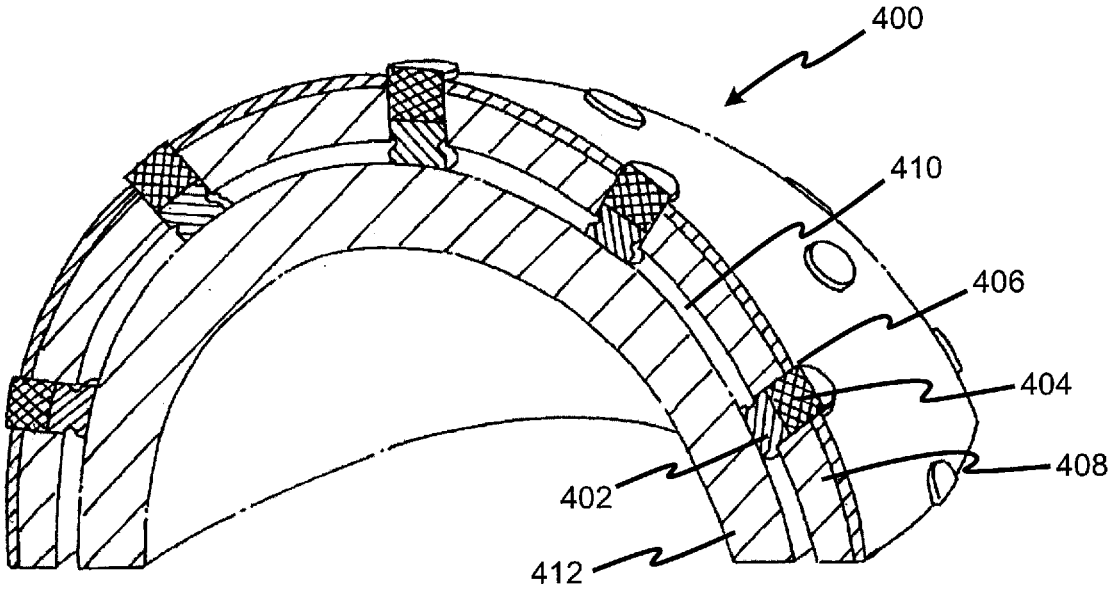
FIG. 12 is a partial cross-sectional view through another example helmet with inner and outer liners, showing isolation dampers coupled between the liners and fittings extending through recesses in the outer liner and respectively coupled to the isolation dampers in accordance with an embodiment.

FIG. 12 is a partial cross-sectional view through another example helmet with inner and outer liners, showing isolation dampers coupled between the liners and fittings extending through recesses in the outer liner and respectively coupled to the isolation dampers, in accordance with an embodiment. FIG. 12 is a cross-sectional view of another example embodiment of a helmet 400 in which isolation dampers 402 are affixed, e.g., with an adhesive, to an outer surface of an inner liner 412, and associated plugs 404 extending through corresponding recesses 406 disposed in the outer liner 408 to fill the recesses to establish a desired "pre-load" on the isolation dampers 402. The isolation dampers 402 are selectively distributed across the geometry of the helmet 400. As discussed above, the isolation dampers 402 can maintain a selected spacing or gap 410 between the inner liner 412 and outer liner 408. Also, it should be understood that, as in the embodiments above, the isolation dampers 402 can be distributed in any arrangement desired to tune the particular energy management characteristics of the helmet 400. The arrangement of the isolation dampers 402 can be regular or irregular, and can allow for a complete separation or a partial contact between different liners.

Figure 13:
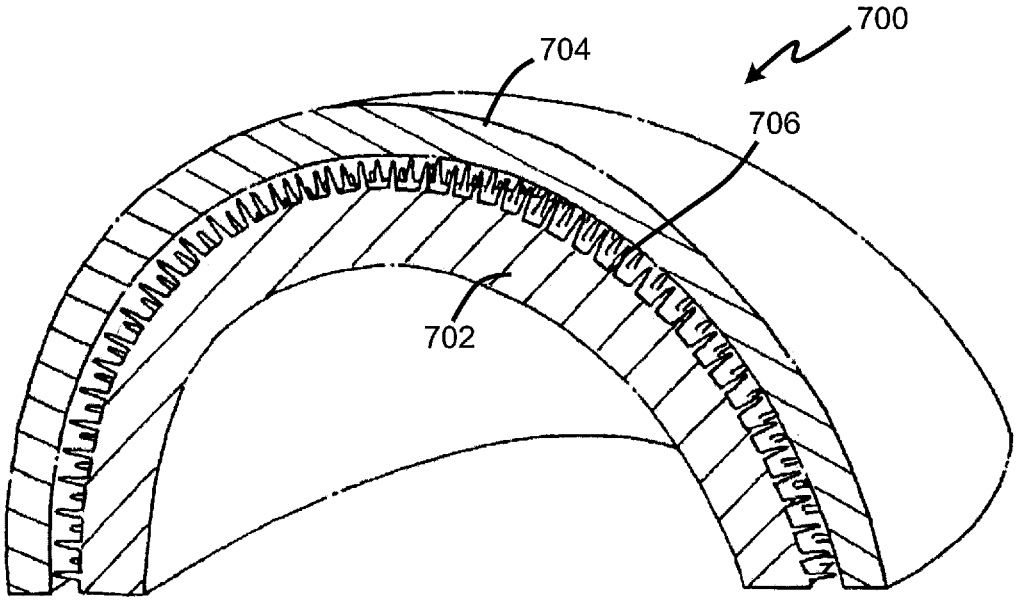
FIG. 13 is a partial perspective view of a helmet inner and outer liner, showing another example of isolation dampers in accordance with an embodiment.

FIG. 13 is a partial perspective view of a helmet inner and outer liner, showing another example of isolation dampers, in accordance with an embodiment. FIG. 13 illustrates an embodiment of a helmet liner assembly 700 in which the outer and inner liners 702 and 704 are spaced by an optional isolation damping method, which is retained by various bonding agents or mechanical means. This embodiment consists of the outer and inner liners 702 and 704 spaced by a high density array of small diameters of flexible columns 706, like a hair brush or "porcupine," that are attached to both liners by mechanical means or bonding, that displace under impact in any direction providing omnidirectional movement in linear impact and shearing forces. The elastomeric porcupine material 706 can be made as individual components or as a molded assembly and applied in various array patterns between the two liners 702, 704 or designed to be over molded into the liner materials as an alternative method. As small cylindrical shaped columns 706, this embodiment will compress and buckle under an impact load as well as provide movement in rotational shear as the columns bend and compress under load. The negative of this method is that there is a lot of material in the dampers 706 that will be compressed onto its self as it has no specific volume to retreat into as it compresses as in previous embodiments described, to get a good result it may take a much larger gap between the two liners to achieve desired performance.

Figure 14:
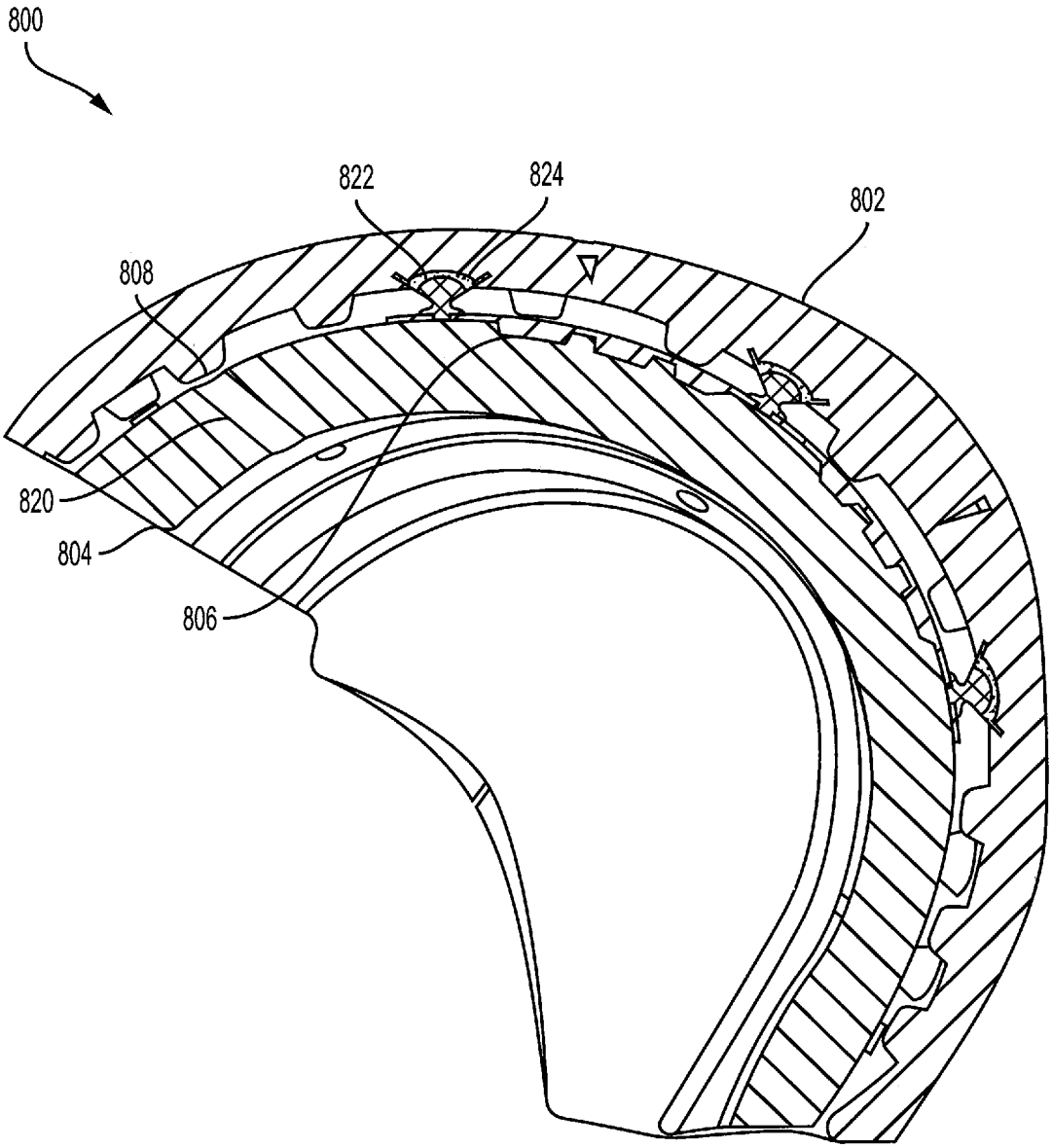
FIG. 14 is a cross-sectional view of an example of a helmet in accordance with an embodiment.

FIG. 14 is a cross-sectional view of an example of a helmet in accordance with an embodiment. The embodiment of the helmet of FIG. 14 includes at least two layers and is designed to absorb both translational and rotational forces. Helmet 800 of FIG. 14 includes an outer liner 802, an inner liner 804, a substrate 806, isolation damper 822, and insert 824.

The outer liner 802 may be disposed of or contained within an outer shell (not shown) of the helmet 800. The outer shell may be a relatively hard outer shell (i.e., harder than the liners of the helmet 800) and may be made from, for example, polycarbonate, ABS plastic, PVC plastic, nylon, fiberglass, carbon fiber, carbon fiber reinforced plastic, other plastics, wood, metals, or other suitable materials. The outer shell may contain the various components highlighted in FIG. 14. The outer liner 802 may, in various embodiments, be bonded to the outer shell, attached to the outer shell through mechanical fasteners such as screws, rivets, and mechanical attachment features on one or both of the outer shell and the outer liner 802, and/or placed inside the outer shell and allowed to translate and/or rotate.

The outer liner 802 may be disposed between the outer shell and any inner liners, dampers, or other components. The outer liner 802, in various embodiments, may be formed of any suitable material, including energy absorbing materials of the types commonly used in the industry, such as expanded polystyrene (EPS) or expanded polypropylene (EPP).

In addition to the properties of the material of the outer liner 802, the outer liner 802 may also include various features that may absorb force. For example, in a certain embodiment, the outer liner 802 may include the lug 808. The lug 808 may be a protrusion from a side of the outer liner 802. In various embodiments, the lug 808 may be on the outside (i.e., the side closer to the outer shell) or may be on the inside (i.e., the side closer to the inner liner 804) of the outer liner 802. The lug 808 may deform when subjected to a force. The force may be an axial force, a lateral force, a rotational motion, another type of force, or a combination of such forces. In various embodiments, the lug 808 may be molded from the same material as the outer liner 802 and may be a part of the outer liner 802 (that is, for example, manufactured from the same mold). In the embodiment shown in FIG. 14, the inner liner 804 may include a surface for the lug 808 to contact. The lug 808 may contact the inner liner 804 or there may be, when the helmet 800 is in a normal operating condition or a resting position (i.e., not absorbing a force), a space separating the lug 808 from the inner line 804. In such embodiments, the helmet may smoothly ramp up resistance force of the liners by allowing the lug 808 to contact or engage the inner liner 804 at certain stages of deformation of the inner liner 804. Accordingly, the outer liner 802 or the inner liner 804 may include a plurality of lugs, such as more than 2, more than 10, more than 20, more than 30, or more than 40 lugs. The lugs may all be the same height, or the various lugs may be a plurality of different heights. When the lugs may be one of a plurality of different heights, the height, the material, and the quantity of lugs at any specific height may be selected to allow the resistance force of the liners to smoothly ramp. Additionally, while the inner liner 804 of the embodiment shown in FIG. 14 may not include detents or cup-like features to contact and/or locate the lug 808, other embodiments of the inner liner 804 may include such features or there may be a separate layer with such features.

The inner liner 804 may be disposed of or contained within the outer liner 802. The inner liner 804 may, similar to the outer liner 802, be formed of any suitable material, including energy absorbing materials of the types commonly used in the industry, such as expanded polystyrene (EPS) or expanded polypropylene (EPP). In various embodiments, the inner liner 804 may also be bonded, attached via mechanical fasteners such as screws, rivets, and mechanical attachment features, and/or placed inside the outer liner 802 and allowed to translate and/or rotate. In certain embodiments, the inner liner 804 may also be attached to the outer shell.

In certain embodiments, the inner liner 804 may include a lug or a plurality of lugs. The lugs may be similar to the lug 808. In embodiments when the inner liner 804 includes a lug or a plurality of lugs, a component the lug 808 may be configured to contact, such as the outer liner 802, the outer shell, or an intermediate liner, may not include detents or cup-like features to contact and/or locate the lug. Other embodiments of such components may include such features or there may be a separate layer with such features.

The substrate 806 may be an intermediate layer between the outer liner 802 and the inner liner 804. The substrate 806 may, in certain embodiments, be a support for the isolation damper 822 or a plurality of isolation dampers. The isolation damper 822 may, in certain embodiments, be an elastomeric structure and be designed to absorb shock and/or allow controlled movement of the inner liner 804 relative to the outer liner 802. The isolation damper 822 may allow the inner liner 804 to translate and/or rotate relative to the outer liner 802. Thus, the isolation damper 822 may allow omnidirectional movement of the inner liner 804 relative to the outer liner 802, or vice versa. Such allowed movement may better absorb translation and/or rotational movement of a helmet wearer's head and thus offer improved protection. The isolation damper 822 may be formed of a wide variety of elastomeric materials, including MCU (micro-cellular urethane), EPU, natural rubber, synthetic rubbers, foamed elastomers of various chemical constituents, solid cast elastomers of various chemical constituents, encased liquids, gels or gasses providing flexible structures, and any flexible assembly of any other kind that will provide the desired degree of omnidirectional movement.

Additionally, the isolation damper 822 may include one or more protrusions. In certain embodiments, the protrusions may be optional features. The protrusions may include features to, for example, absorb shock or couple various components together. Accordingly, the isolation damper 822 may also include conical, spherical, partially spherical or conical, rectangular, or other such geometric features. Features and/or with corresponding geometries (e.g., configured to receive a conical or spherical shape) may be fitted into the corresponding liners or other components that may receive the isolation damper 822. Other embodiments of the isolation damper 822 may not include protrusions and/or may be substantially cylindrical in profile.

In certain embodiments, the isolation damper 822 may be a part of an assembly to couple together the outer liner 802 and the inner liner 804. In such an embodiment, the isolation damper 822 may, for example, mechanically couple to one or both of the outer liner 802 or the inner liner 804. The isolation damper 822 may also, alternatively or in addition to, be coupled to the substrate 806. The substrate 806 may then be coupled to one or both of the outer liner 802 and the inner liner 804. In the helmet 800, the isolation damper 822 may be coupled to the substrate 806 on one end and the outer liner 802 on another end. The substrate 806 may then be coupled to the inner liner 804.

The outer liner 802 may include the insert 824 to receive the isolation damper 822. The insert 824 may be a recess or aperture within the inner liner 804 and/or outer liner 802. The recess or aperture may be fitted with inserts or cup-like inserts that locate and retain the isolation dampers 822 in place, provide additional support for the isolation dampers 822 within the liners, and/or help to manage and disburse impact forces acting on the helmet 800. The insert 824 may be configured with any suitable geometry and can include flanges of appropriate sizes and/or shapes to distribute forces over a larger area of a corresponding one of the liners.

In some embodiments, the insert(s) respectively disposed on the inner and/or outer liners 804 and/or 802 may be over-molded into the associated liner for attachment purposes, and may utilize a circumferential flange or multiple circumferential flanges in various sizes and configurations to help retain and distribute forces within the material of the associated liner.

The insert 824 may be held in the associated liner by, for example, friction, or alternatively, by any other suitable means, including adhesives, heat bonding and/or welding, and similarly, the respective ends of the isolation damper 822 may be held in the corresponding insert 824 by friction, or alternatively, be fixed in the insert 824 by any other suitable method or means. The insert 824 may be made of any suitable material, including thermosetting or thermoforming plastics, such as acrylonitrile butadiene styrene (ABS), polyvinylchloride (PVC), polyurethane (PU), polycarbonates, nylon, various alloys of metals, and the like.

In addition to impact absorbing features, the helmet 800 may also include features to improve comfort. For example, the inner liner 804 may include a vent 820 to improve ventilation within the helmet 800. The vent 820 may be a cutout of various geometries within the inner liner 804 to allow air to flow through the inner liner 804. In other embodiments, vents may also be present on the outer liner, on intermediate liners, or on other components within the helmet 800.

Figure 15:
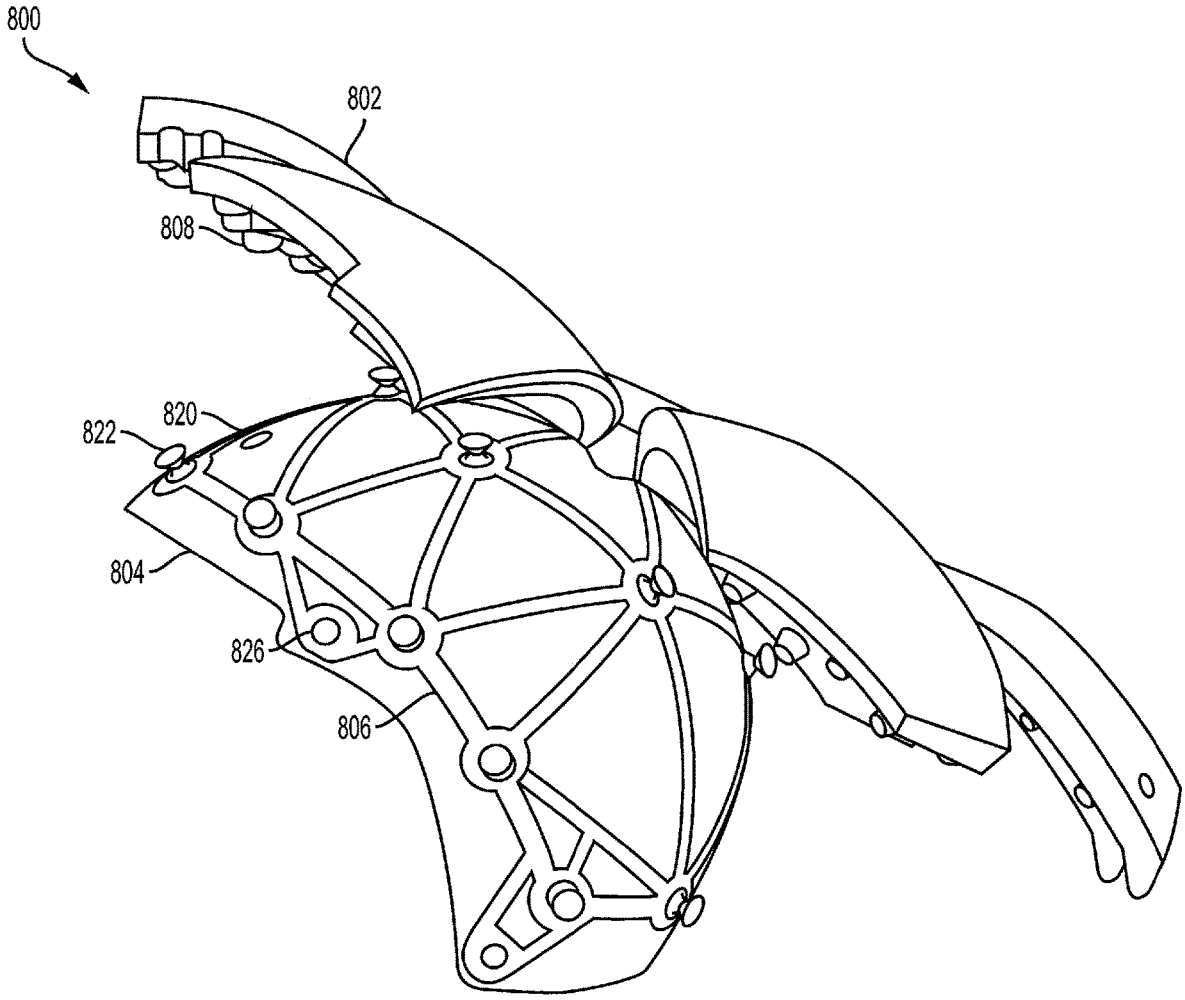
FIG. 15 is another view of the example helmet of FIG. 14 in accordance with an embodiment.

Referring back to the substrate 806, the substrate 806 may be coupled to the inner liner 804 through various different methods and components. FIG. 15 illustrates one such method. FIG. 15 is another view of the example helmet of FIG. 14 in accordance with an embodiment. The helmet 800 in FIG. 15 includes the outer liner 802, the inner liner 804, the substrate 806, isolation damper 822, and attachment feature 826. The various components in FIG. 15 may be similar to their respective components in FIG. 14.

In FIG. 15, the outer liner 802 may be shown in an unfolded configuration. The unfolded configuration may be similar to or the same as how the outer liner 802 is manufactured. In such embodiments, the outer liner 802 may be manufactured in a substantially flat pattern. The outer liner 802, as well as other components described herein, may include cutouts to allow the outer liner 802 and other components to fold into a cup-like shape that would substantially conform to a wearer's head.

In addition to the components of FIG. 15 that is also included in FIG. 14, the helmet 800 in FIG. 15 also includes the attachment feature 826. In various embodiments, the attachment feature 826 may be a pin, a bolt, a nut configured to engage a bolt, a stand-off, an adhesive, welding, tape or Velcro, or other suitable fastener. For example, in the embodiment shown in FIG. 14, the attachment feature 826 may be a pin that may be inserted into the inner liner 804 to couple the substrate 806 to the inner liner 804. The portion of the inner liner 804 that may receive the pin may include features to prevent the pin from easily backing out. For example, the inner liner 804 may include a hole configured to receive the pin and the hole may include a raised surface around at least a portion of the circumference of the hole. The raised surface may then contact the pin or features on the pin designed to receive the raised surface and may prevent the pin from backing out of the hole. In other embodiments, the pin may instead include such features instead of the hole or the hole and pin may both include such features.

The attachment feature 826 may also be other features. For example, the attachment features 826 may be a stand-off or pin rising from the inner liner 804. The substrate 806 may include a feature, such as a hole, that may receive the stand-off or pin. The stand-off or pin may then be inserted into the hole. In certain embodiments of the substrate 806, the substrate 806 may include multiple holes and the inner liner 804 may include a corresponding number of stand-offs or pins. In such an embodiment, the substrate 806 may be stretched over the stand-offs or pins of the inner liner 804 during assembly. Once assembled, the substrate 806 may then be contained on the inner liner 804 through the shape of the substrate 806 alone, through fasteners such as screws, bolts, adhesives, or Velcro, or through a combination of multiple different methods of securing the substrate 806 to the inner liner 804.

Figure 16A:
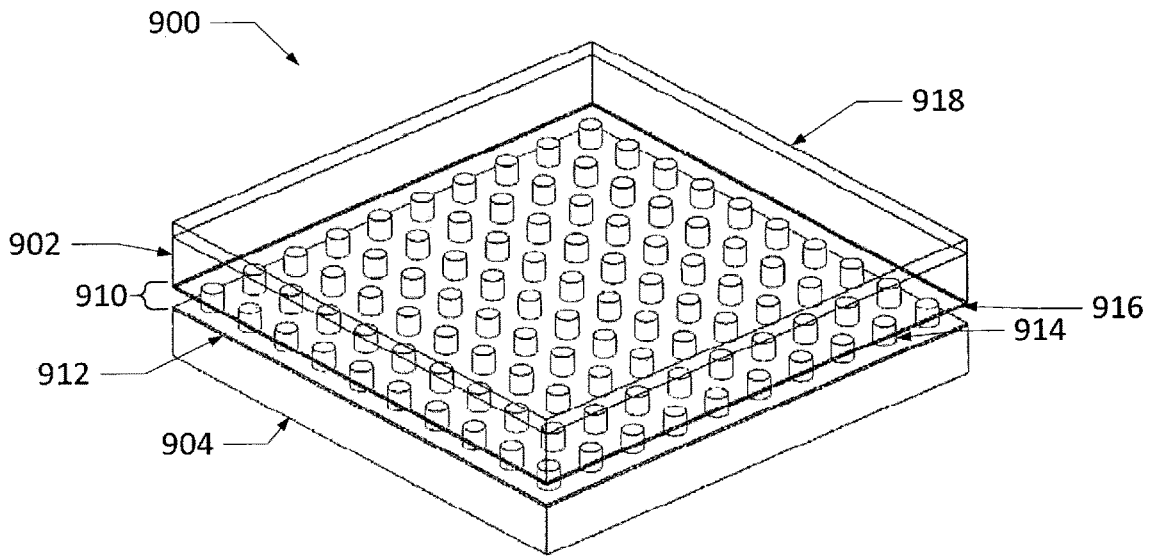
FIGS. 16A and 16B are isometric and cross-sectional views of an impact absorbing system of a helmet in accordance with an embodiment.
Figure 16B:
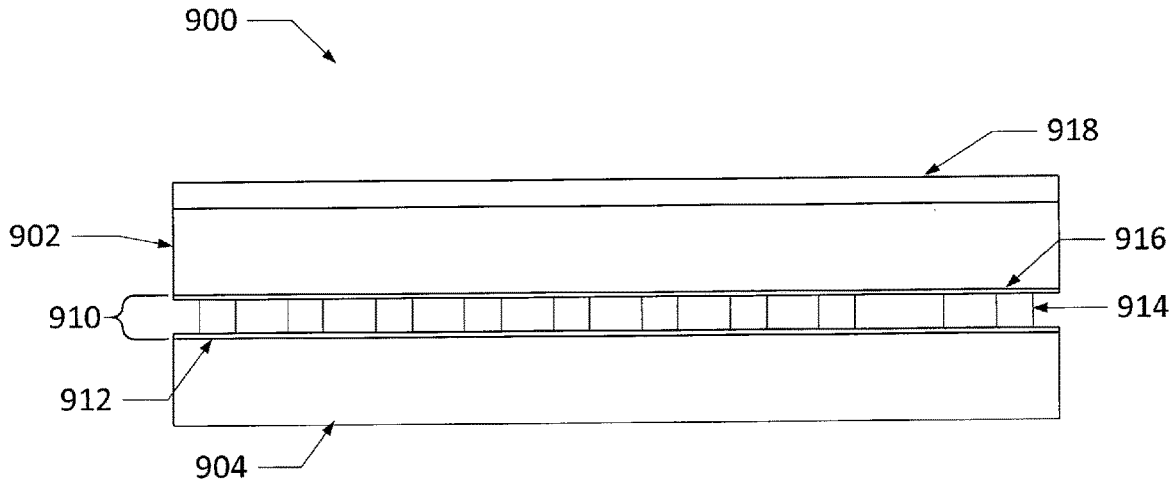

In addition to the liner and isolation damper configuration shown in FIGS. 14 and 15, various other configurations are possible to absorb impact. FIGS. 16-20 show examples of such possible configurations. FIGS. 16A and 16B are isometric and cross-sectional views of an impact absorbing system of a helmet in accordance with an embodiment.

The impact absorbing system 900 includes an outer liner 902, an inner liner 904, a damper array 910, and an outer shell 918. The outer liner 902, the inner liner 904, and the outer shell 918 may be similar to their respective components described in FIG. 14. The damper array 910 may include a first substrate 912, dampers 914, and a second substrate 916. In FIG. 118A, the outer shell 918, the outer liner 902, and the second substrate 916 may be see-through to allow a better view of the dampers 914.

The first substrate 912 may be a substrate made from the same material as the damper 914 or may be made from a different material. In certain embodiments, the first substrate may be harder than the damper 914 and may be, for example, polycarbonate, nylon, ABS plastic, PVC plastic, graphite, wood, metal, fiberglass, carbon fiber, Kevlar, or other suitable materials. In such embodiments, dampers 914 may be bonded or coupled to the first substrate 912. For example, the dampers 914 may be bonded through an adhesive such as glue or through mechanical fasteners such as screws and push-pins. The first substrate 912 may aid in more evenly distributing force to the dampers 914 and/or to a substrate. Additionally, the first substrate 912 may also be coupled to the inner liner 904 through any appropriate way. For example, the first substrate 912 may be bonded to, molded, or fastened to the inner liner 904.

The damper 914 may be an impact absorbing damper and may include any or all features of an isolation damper. The damper 914 may allow for omnidirectional movement of the inner liner 904 relative to the outer liner 902 and/or the outer shell 918 and may be of any appropriate material or geometry. Examples of suitable materials include MCU (microcellular urethane), EPU, natural rubber, synthetic rubbers, foamed elastomers of various chemical constituents, solid cast elastomers of various chemical constituents, encased liquids, gels or gasses providing flexible structures, and any flexible assembly of any other kind that will provide the desired degree of omnidirectional movement. The suitable materials may be isotropic or anisotropic.

In various embodiments, the number of dampers 914 may be varied depending on the desired deformation characteristics. In certain embodiments, including a plurality of dampers may more evenly distribution force across the dampers and, thus, reduce the likelihood of damage, such as tearing, permanent deformation, or other gouges, to the dampers 914, the first substrate 912, the second substrate 916, the inner liner 904, and/or the outer liner 902.

The damper 914 may be of a geometry shaped to absorb shock. For example, the damper 914 may include a generally circular disk having a concave, e.g., generally spherical, recess disposed in a lower surface thereof, a correspondingly shaped convex protrusion extending from an upper surface thereof, and a flange extending around the circumference thereof. In some embodiments, the damper 914 may include elongated cylindrical members.

Various embodiments may have all of the dampers be a certain shape or may include dampers with a plurality of different shapes, sizes, and/or materials. Different dampers designs may be used for specific applications and may be effectively "tuned" to manage the anticipated rotational and translational forces applied. The dampers may be variously configured to control the amount of rotational force that will cause displacement of the various liners of the helmet and may be configured such that they will tend to cause the inner liner 904 to return to its original position relative to the outer liner 902 after the force of an impact is removed from the helmet.

In some embodiments, limits or "stops" may be designed into and between the liners to prevent over-rotation or over-displacement between the layers during an impact incident. Other embodiments may use other features of the helmet to act as stops. In certain embodiments, there may be dampers of various different heights or geometries. As the inner liner 902 compresses further from its normal resting position, relative to the outer shell 918, the dampers may smoothly ramp up resistance force. For example, a certain embodiment may only have 40% of the damper engaging and offering resistance to movement at the normal resting position, but as the inner liner 902 compresses, additional dampers may engage and offer resistance to movement. The dampers 914 may also be of multiple different geometries to allow for the rate that their resistance force ramps up to vary depending on the amount of displacement of the inner liner 904. For example, the dampers 914 may include grooves and flares for such purposes.

Additionally, the damper 914 may be coupled to the second substrate 916. The second substrate 916 may be a substrate made from the same material as the first substrate 912 and/or the damper 914 or may be made from a different material. In certain embodiments, the second substrate 916 may be bonded or coupled to at least a portion of the dampers 914 and/or the outer liner 916.

Certain embodiments may not include one or both of the first substrate 912 or the second substrate 916. In embodiments with only one substrate instead of two substrates, the dampers may be coupled to the one substrate at one end and at least a portion of the dampers may contact or engage the liner at another end. In embodiments without substrates, the dampers may be coupled to at least one of the liners or may be molded into at least one of the liners.

Figure 17A:
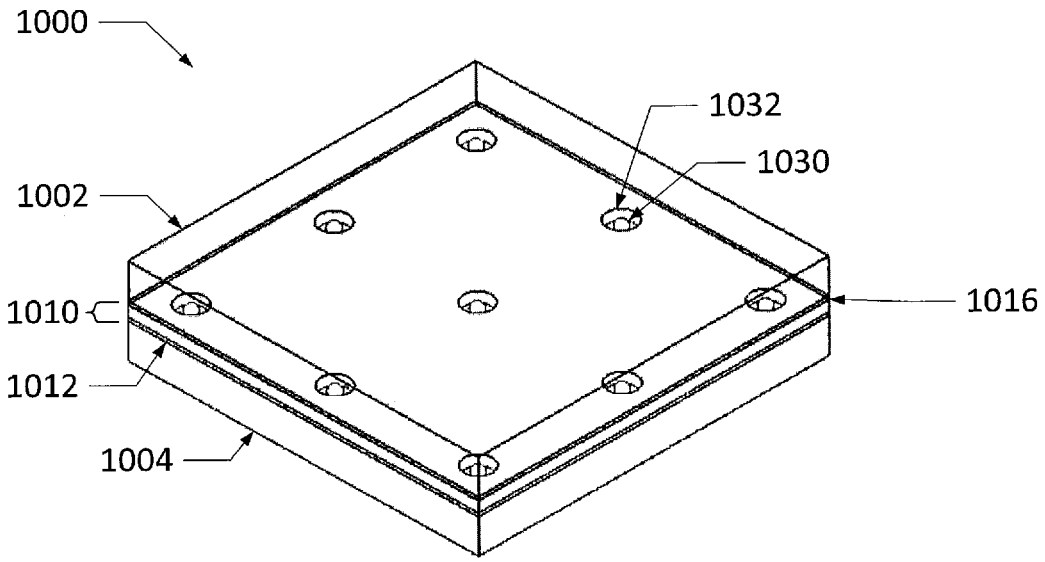
FIGS. 17A and 17B are isometric and cross-sectional views of another impact absorbing system of a helmet in accordance with an embodiment.
Figure 17B:
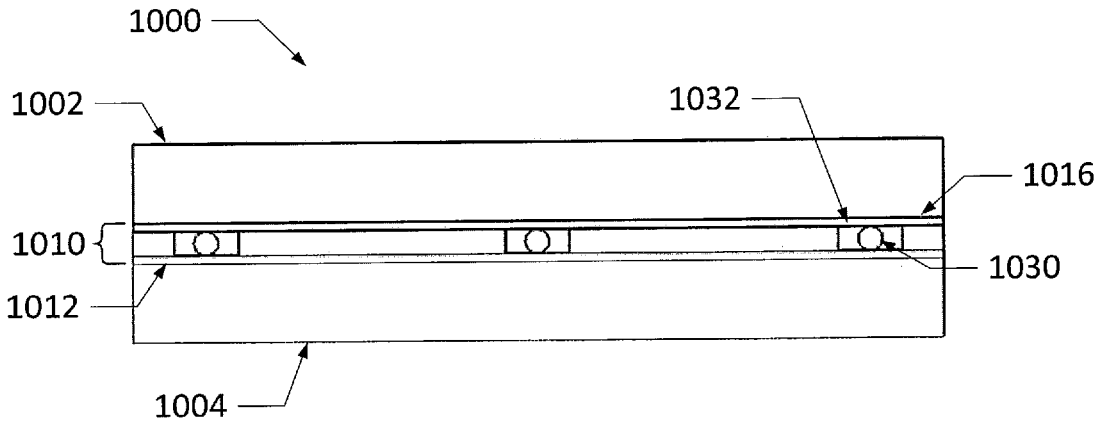

Various other impact absorbing systems are possible. FIGS. 17A and 17B are isometric and cross-sectional views of another impact absorbing system of a helmet in accordance with an embodiment. The impact absorbing system 1000 of FIGS. 17A and 17B includes an outer liner 1002, an inner liner 1004, and a damper array 1010. The damper array 1010 may include a first substrate 1012, ball 1030, housings 1032, and a second substrate 1016. In FIG. 17A, the outer liner 1002 and the second substrate 1016 may be see-through to allow a better view of the balls 1030 and the housings 1032.

The balls 1030 and the housings 1032 may allow for movement of the inner liner 1004 relative to the outer liner 1002. The balls 1030 may allow for movement in all directions. The balls 1030 may, in certain embodiments, be made of an elastomeric material and may compress if subjected to a force. While certain embodiments may allow the balls 1030 to roll freely, other embodiments may couple the balls 1030 to one, some or all of the inner liner 1004, the outer liner 1002, the first substrate 1012, and the second substrate 1016.

The housings 1032 may each enclose a ball or a plurality of balls. The housings 1032 may provide a limit of movement for the inner liner 1004 relative to the outer liner 1002. In certain embodiments, the housings 1032 may be made from an elastomeric material.

The first substrate 1012 and/or the second substrate 1016 may be substrates made from a relatively firm material, such as polycarbonate, to allow the balls 1030 to translate. Alternatively, the material of the first substrate 1012 and/or the second substrate 1016 may be tuned to offer a resistance to the translation of the balls 1030. In such an embodiment, the first substrate 1012 and/or the second substrate 1016 may be made from an elastomeric material so that, in a resting position, the substrate may deform where the ball 1030 contacts the substrate and thus offer a resisting force to movement of the ball 1030.

Additionally, certain embodiments may not include the housings 1032. In such embodiments, the balls 1030 may be allowed to freely roll or substrates and/or the liners may include features to contain the balls 1030 that serve the same function as the housings 1032, such as limiting the movement of the balls 1030 or ramping up resistance force to movement of the balls 1030 when the balls 1030 move away from a "center" position.

Figure 18A:
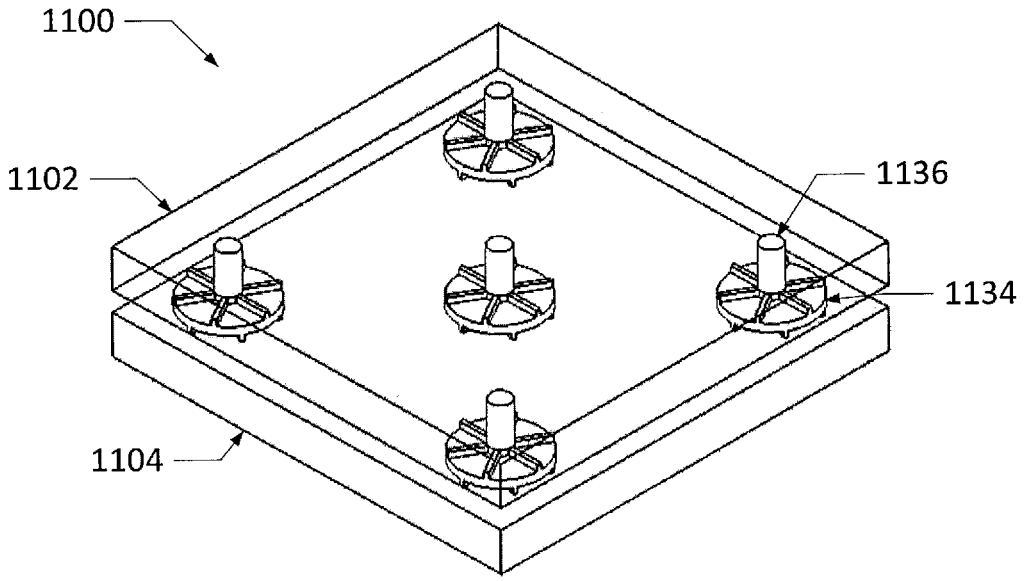
FIGS. 18A and 18B are isometric and cross-sectional views of a further impact absorbing system of a helmet in accordance with an embodiment.
Figure 18B:
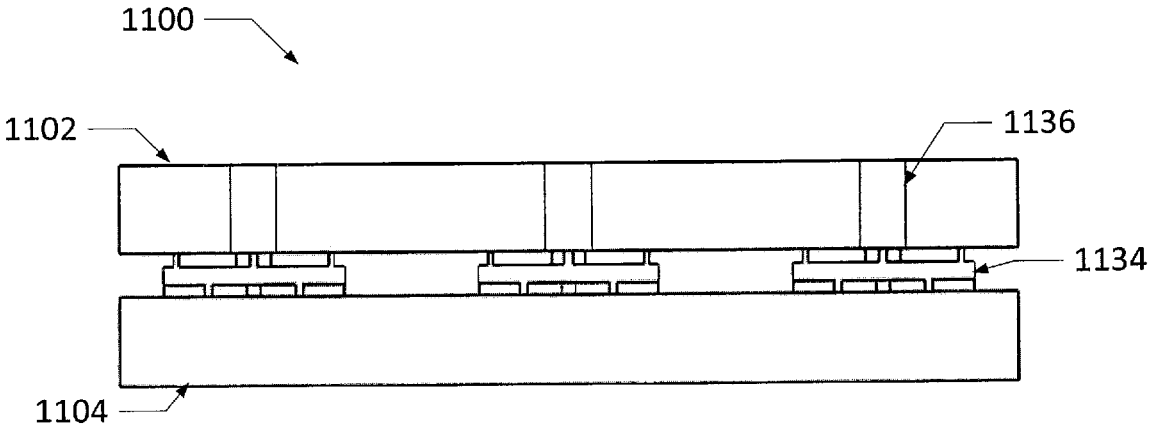

FIGS. 18A and 18B are isometric and cross-sectional views of a further impact absorbing system of a helmet in accordance with an embodiment. The impact absorbing system 1100 of FIGS. 18A and 18B includes an outer liner 1102, an inner liner 1104, compression dampers 1134, and cylindrical dampers 1136. The compression dampers 1134 and the cylindrical dampers 1136 may replace the damper array. In FIG. 18A, the outer liner 1102 may be see-through.

The compression damper 1134 may be an off the shelf vibration compression damper. Alternatively, the compression damper 1134 may be a custom shape. The cylindrical damper 1136 may be coupled to the compression damper 1134 or may be molded as the same part as the compression damper 1134. The cylindrical damper 1136 may be bonded or coupled to the outer liner 1102 or the inner liner 1104. In certain other embodiments, there may be multiple cylindrical dampers coupled to the compression damper 1134 and the cylindrical dampers may be coupled to both the inner liner and the outer liner.

Figure 19A:
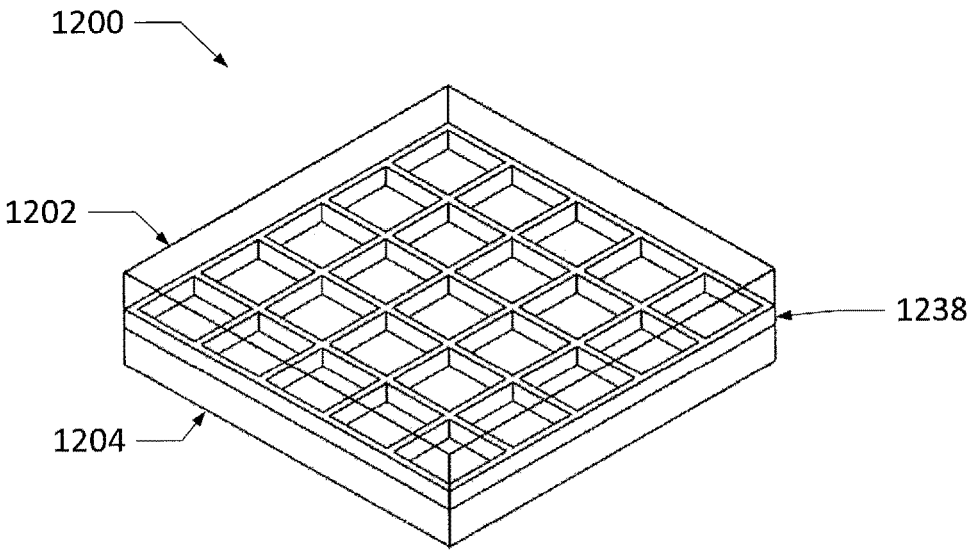
FIGS. 19A and 19B are isometric and cross-sectional views of yet another impact absorbing system of a helmet in accordance with an embodiment.
Figure 19B:
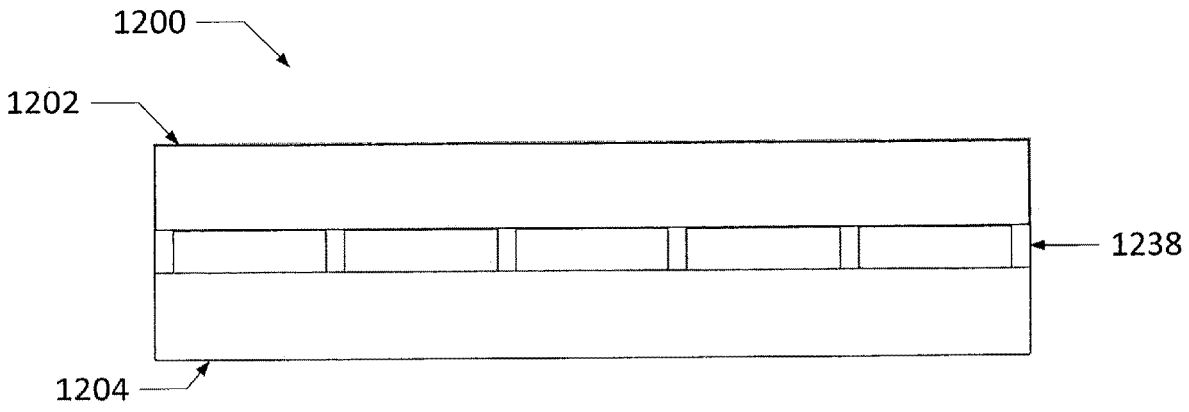

FIGS. 19A and 19B are isometric and cross-sectional views of yet another impact absorbing system of a helmet in accordance with an embodiment. The impact absorbing system 1200 of FIGS. 19A and 19B includes an outer liner 1202, an inner liner 1204, and a damper array 1238. In FIG. 19A, the outer liner 1202 may be see-through to allow a better view of the damper array 1238.

The damper array 1238 may be a sheet of compressible material with internal void areas. The sheet may be designed to compress and shear when subjected to a force. The damper array 1238 may shear and/or compress in any direction. The damper array 1238 may be shaped into thin cross sections. The damper array 1238 may compress or deform linearly or may be configured to smoothly ramp resistance to compression or deformation in any force curve that may be beneficial. While the damper array 1238 includes void areas that are rectangular in shape, other embodiments of the damper array 1238 may include void areas that are of other shapes, such as circular, hexagonal, and other geometric shapes. The percentage of the damper array 1238 that is made up of the void area may be varied depending on the desired compression characteristics.

While the damper array 1238 of the helmet 1200 does not include a substrate, other embodiments of the damper array 1238 may include a first substrate and/or a second substrate. The substrates may serve to equalize the distribution of force.

Figure 20A:
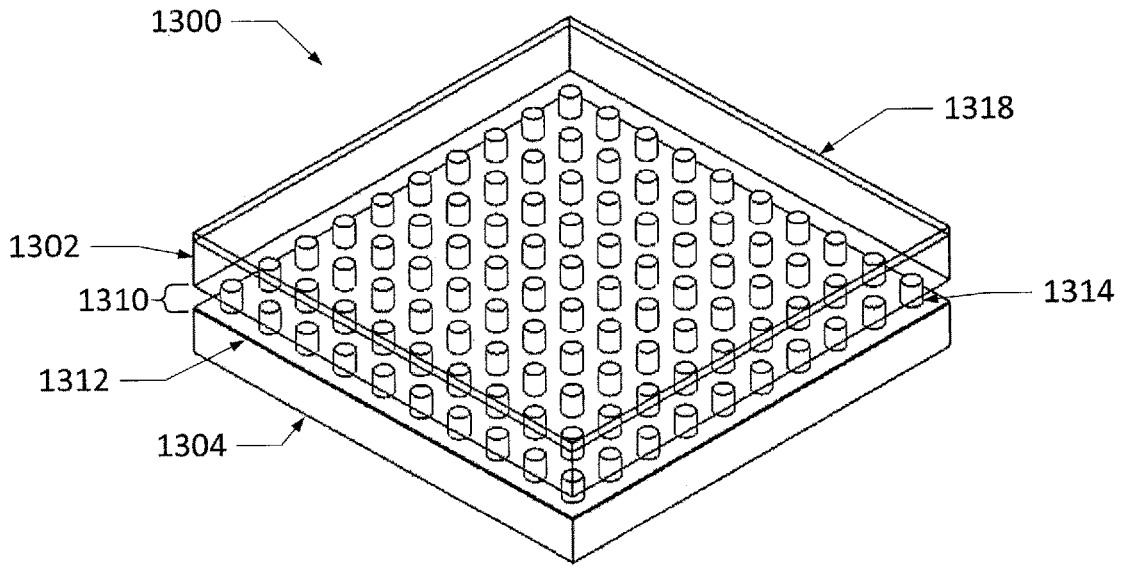
FIGS. 20A and 20B are isometric and cross-sectional views of an alternative embodiment of the impact absorbing system of FIGS. 16A and 16B in accordance with an embodiment.
Figure 20B:
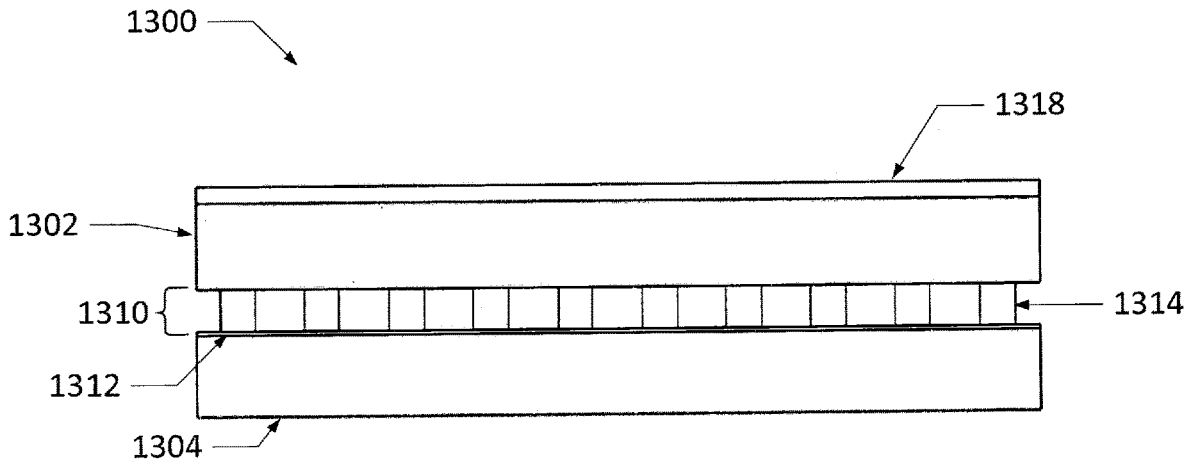

FIGS. 20A and 20B are isometric and cross-sectional views of an alternative embodiment of the impact absorbing system of FIGS. 16A and 16B in accordance with an embodiment. The impact absorbing system 1300 of FIGS. 20A and 20B includes only a first substrate 1312. Unlike the embodiment in FIGS. 16A and 16B, the dampers 1314 may directly contact the outer liner 1302 instead of counting a second substrate. Further embodiments may not include the first substrate 1312. In such embodiments, the dampers may be bonded, attached, or be molded into or from the same part as either the inner liner 1304 and/or the outer liner 1302. In embodiments where the dampers may be bonded or attached to a liner or multiple liners, the dampers may be the same material as the liners, or may be a different impact-absorbing material.

Figure 21:
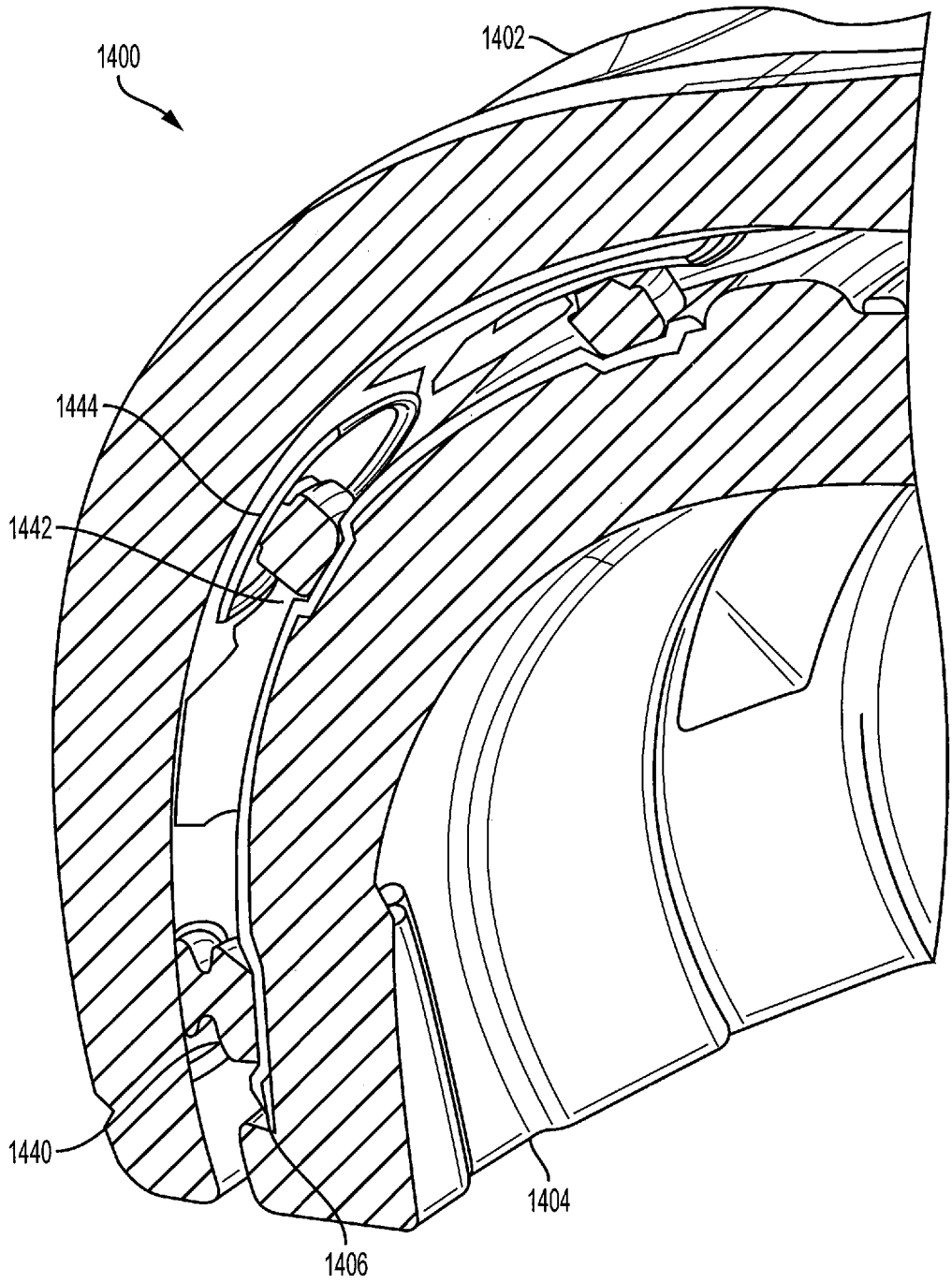
FIG. 21 is a partial cross-sectional view of an additional embodiment of a helmet with an impact absorbing system in accordance with an embodiment.

FIG. 21 is a partial cross-sectional view of an additional embodiment of a helmet with an impact absorbing system in accordance with an embodiment. FIG. 21 may illustrate a helmet 1400 with an outer liner 1402, an inner liner 1404, a substrate 1406, an attachment damper 1440, an isolation damper 1442, and a sliding disc 1444. The substrate 1406 may, in certain embodiments, support for one or more of the attachment damper 1440 and/or isolation damper 1442. The substrate 1406 may be coupled to the inner liner 1404, the outer liner 1402, and/or another component of the helmet 1400.

The attachment damper 1440 may be coupled to the inner liner 1404, the outer liner 1402, and/or another component of the helmet 1400 (e.g., the substrate 1406). The attachment damper 1440 may, in certain embodiments, couple and position the inner liner 1404 relative to the position of the outer liner 1402. The attachment damper 1440 may be coupled to the inner liner 1404, the outer liner 1402, the substrate 1406, and/or other component of the helmet 1400 through adhesives (e.g., glues), through mechanical fasteners (e.g., pins, bolts, rivets, or other mechanical attachment components), and/or through friction or other attachment techniques (e.g., molded to or within such other components).

In certain impact situations, the inner liner 1404 may move relative to the outer liner 1402 or vice versa. The attachment damper 1440 may then, after movement of the inner liner 1404 relative to the outer liner 1402, return the inner liner 1404 and/or the outer liner 1402 to the original position or substantially the position before movement. In certain embodiments the attachment damper 1440 may also be configured to receive forces imparted to the helmet and absorb the forces. Such forces may include oblique angle forces.

The isolation damper 1442 may be coupled to the sliding disc 1444. In certain embodiments, the isolation damper 1442 may be bonded, mechanically fastened, friction fit, or coupled through other techniques to the sliding disc 1444. The sliding disc 1444 may be configured to move relative to (e.g., slide on) the inner liner 1404 and/or the outer liner 1402. For example, if the helmet 1400 is subjected to an oblique force, the inner liner 1404 may move relative to the outer liner 1402 and thus the isolation damper 1442 and the sliding disc 1444 may move relative to inner liner 1404 and/or the outer liner 1402. Accordingly, in embodiments with some or all of the isolation dampers 1442 coupled to sliding discs 1444, there may be lower resistance to lateral movement of the inner liner 1404 relative to the outer liner 1402 and, as such, lower amounts of oblique force may be transferred to the wearer. In certain such embodiments, the helmet 1400 may also include attachment dampers 1440 that may then reposition the inner liner 1404 relative to the outer liner 1402 after an impact.

Figure 22:
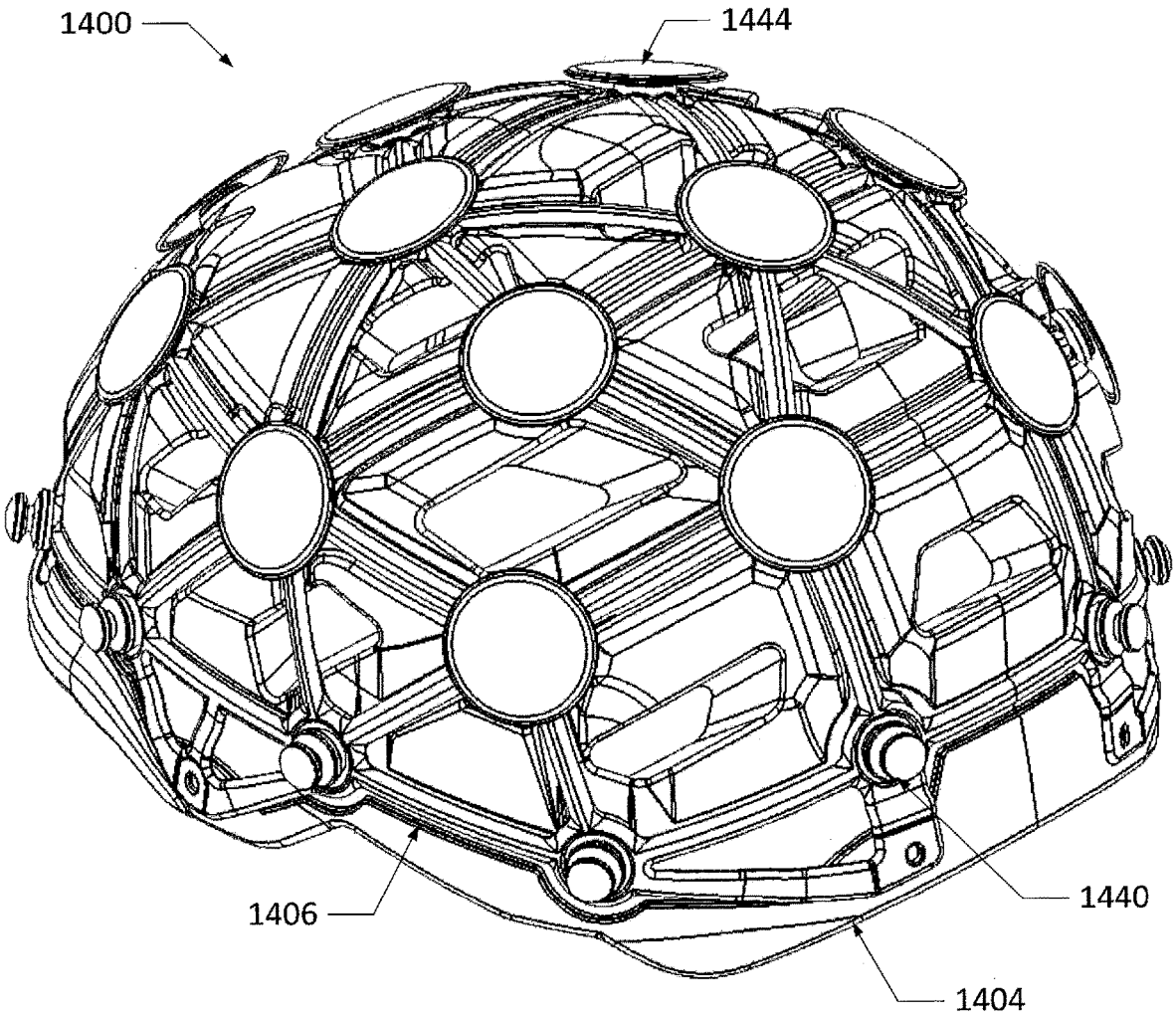
FIG. 22 illustrates certain components of the helmet of FIG. 21 in accordance with an embodiment.

FIG. 22 illustrates certain components of the helmet of FIG. 21 in accordance with an embodiment. FIG. 22 may further illustrate the inner liner 1404, the substrate 1406, the attachment dampers 1440, and the sliding disc 1444 of the helmet 1400. As shown, the substrate 1406 may be a frame that various components of the helmet 1400 (e.g., the isolation dampers 1442 shown in FIG. 21) may be coupled to. In certain embodiments, the isolation dampers 1442 may be coupled to the substrate 1406. In certain embodiments, the substrate 1406 may then be coupled to the inner liner 1404 and/or the outer liner 1402 via the attachment dampers 1440. In certain such embodiments, the inner liner 1404, the outer liner 1402, and/or the substrate 1406 may include an opening that may receive a portion of the attachment damper 1440. The attachment damper 1440 may then be inserted through the opening to couple together the inner liner 1404, the outer liner 1402, and/or the substrate 1406. In certain such embodiments, one or more of the openings may be sized to be a friction fit with the corresponding attachment damper 1440. As such, the inner liner 1404, the outer liner 1402, the substrate 1406, and/or the attachment damper 1440 may then be coupled together without the need for adhesives. For example, in certain embodiments, the attachment damper 1440, the isolation damper 1442, and/or other components may be molded into one or more of the inner liner 1404, the other liner 1402, and/or the substrate 1406. In other embodiments, the single attachment damper 1440 shown in FIG. 22 may be replaced with a plurality of components.

The sliding discs 1444 may be configured to slide on one or more of the inner liner 1404 and/or the outer liner 1402. The sliding discs 1444 may include a sliding surface that may be of a greater surface area than that of the isolation dampers 1442 attached to the sliding discs 1444. In certain embodiments, the sliding surface may be low friction, due to the material of the sliding disc 1444 and/or due to a coating applied to the surface. Additionally, the sliding discs 1444 may be coupled to the isolation dampers 1442 through adhesives, mechanical fasteners, and/or through friction or other attachment techniques.

Figure 23:
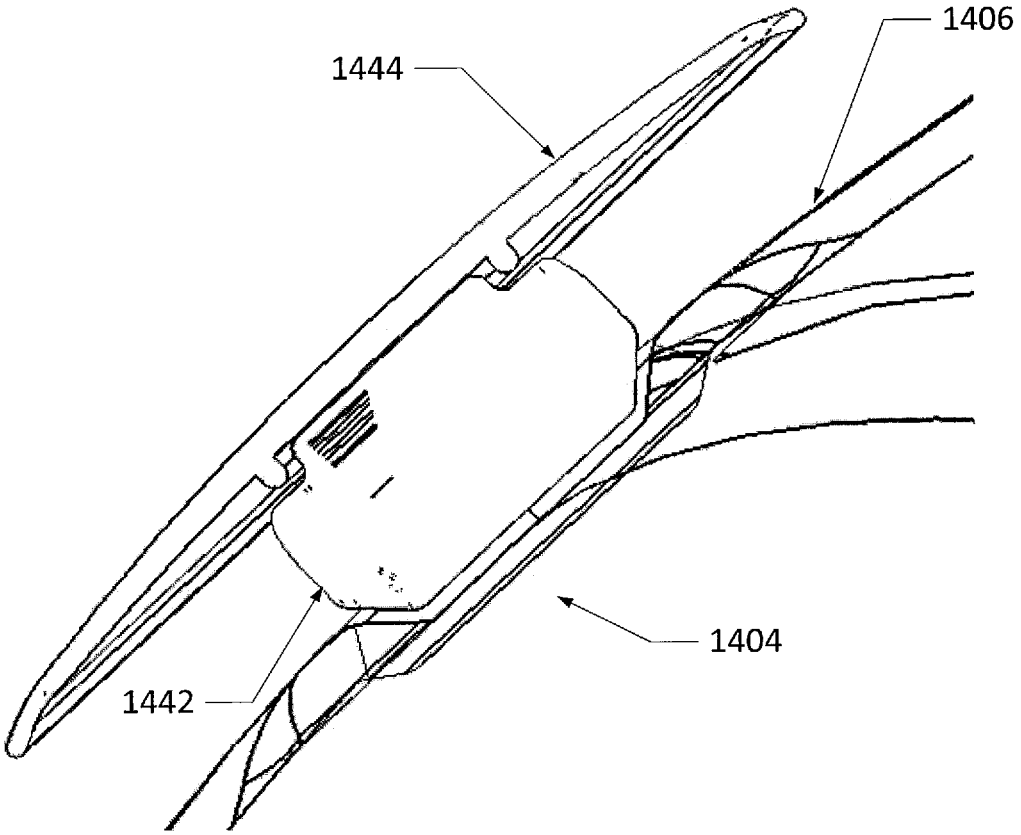
FIG. 23 is a partial cross-sectional view of an additional impact absorbing system of the helmet of FIG. 21 in accordance with an embodiment.

FIG. 23 is a partial cross-sectional view of an additional impact absorbing system of the helmet of FIG. 21 in accordance with an embodiment. FIG. 23 shows the sliding disc 1444, the isolation damper 1442, the substrate 1406, and the inner liner 1404. The isolation damper 1442 may be configured to deflect when subjected to a force (e.g., a force from an impact). In certain embodiments, the isolation damper 1442 may be configured to primarily receive forces applied in a direction normal to a surface of the inner liner 1404. Oblique forces may result in sliding of the isolation damper 1442 and the sliding disc 1444.

In the embodiment shown in FIG. 23, the isolation damper 1442 may be coupled to the substrate 1406, but other embodiments may, additionally or alternatively, couple the isolation damper 1442 to the inner liner 1404, the outer liner 1402, and/or another component of the helmet 100. Additionally, as shown in FIG. 23, the sliding disc 1444 may include features to aid in the coupling of the sliding disc 1444 to the isolation damper 1442. The embodiment shown in FIG. 23 includes, for example, locating features to aid in positioning the sliding disc 1444 relative to the isolation damper 1442 and vice versa.

Figure 24:
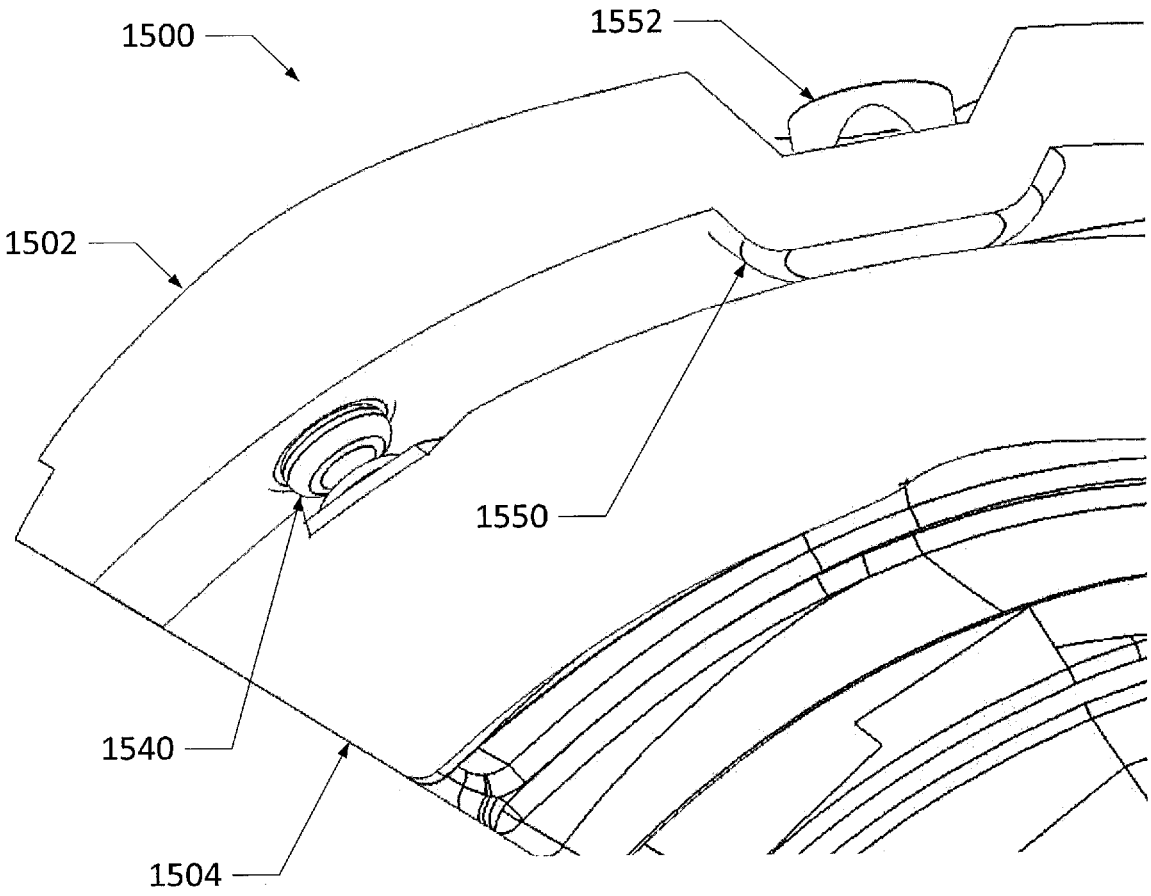
FIG. 24 is a partial cross-sectional view illustrating additional embodiments of an impact absorbing system in accordance with an embodiment.

FIG. 24 is a partial cross-sectional view illustrating additional embodiments of an impact absorbing system in accordance with an embodiment. While certain embodiments of the isolation damper 1442 may include one shock absorbing features, the embodiment shown in FIG. 24 may include a plurality of shock absorbing features.

FIG. 24 illustrates portions of a helmet 1500 with an outer liner 1502, an inner liner 1504, and an attachment damper 1540. The attachment damper 1540 may be similar to other attachment dampers described herein. As such, the attachment damper 1540 may aid in the positioning of the inner liner 1504 relative to the outer liner 1502 and/or another component of the helmet 1500. The outer liner 1502 may include a lug 1550 and a secondary damper 1552. The lug 1550 may extend from a first surface of, for example, the outer liner 1502 and may be configured to absorb force from an impact. Additionally, the lug 1550 may also include a sliding surface. The sliding surface may allow the lug 1550 to slide along a surface of the inner liner 1504 and/or another component upon contact, thus allowing for greater movement of the inner liner 1504 relative to the outer liner 1502. While the lug 1550 is shown to be disposed on the outer liner 1502 in the embodiment in FIG. 24, other embodiments may dispose the lug 1550 on the inner liner 1504 and/or on both the inner liner 1504 and the outer liner 1502. In certain embodiments, the outer liner 1502 may include a recess on the side of the outer liner 1502 opposite that of the lug 1550. Other embodiments may not include such a recess or may include isolation dampers (e.g., isolation damper 1442) that may include one or more such recesses.

Certain embodiments may include the secondary damper 1552. In certain embodiments, the secondary damper 1552 may be disposed within the recess (e.g., within the recess opposite the lug 1550 and/or within a recess of the isolation damper 1442), but other embodiments may dispose the secondary damper 1552 elsewhere (e.g., on another portion of the outer liner 1502 and/or the inner liner 1504). For example, certain other embodiments may include a through-hole within the outer liner 1502 (e.g., at the location of the lug 1550) and the secondary damper 1552 may be disposed within the through-hole or a portion of the through-hole.

In such embodiments, the lug 1550 and/or the outer liner 1502 may be made from a material with a first rate (e.g., elasticity or spring rate). The secondary damper 1552 may be made from a material with a second rate. As such, the lugs 1550 and the secondary damper 1552 may each be tuned to provide protection at different forces and/or impact velocities. Accordingly, FIG. 24 may show an embodiment of a variable spring rate impact absorbing system. In certain embodiments, one or both of the lug 1550 and the secondary damper 1552 may be made from a non-Newtonian material. Such non-Newtonian materials may, for example, be different rates at different forces and/or impact velocities. As such, certain embodiments may not include the secondary damper 1552 and may, instead, only have a non-Newtonian lug 1550 that may be tuned to respond differently at different forces and/or impact velocities while other embodiments may include the lug 1550 and the secondary damper 1552, as well as possibly other impact absorbing components. In embodiments with, at least, the lug 1550 and the secondary damper 1552, one or more of the lug 1550 and the secondary damper 1552 may be made from non-Newtonian materials.

In certain embodiments, the lug 1550 may be configured to engage before the secondary damper 1552 and/or vice versa. As such, for the example of FIG. 24, an impact may first result in deflection of the inner liner 1504. For a portion of the movement, the inner liner 1504 does not contact the lug 1550. After a set amount of deflection, the inner liner 1504 may contact and/or "engage" the lug 1550. As such, the lug 1550 may then provide additional resistance towards movement of the inner liner 1504. When the lug 1550 is initially engaged, the secondary damper 1552 may not contact a component of the helmet 1500 (e.g., an outer shell or another contact). As such, the secondary damper 1552 may not be resisting movement of the inner liner 1504. After additional deflection, the secondary damper 1552 may then engage and the resistance towards movement of the inner liner 1504 may then increase due to the engagement of the secondary damper 1552 (assuming the rates of the lug 1550 and the secondary damper 1552 are constant). The combined spring rate of the lug 1550 and the secondary damper 1552 may be higher than that of just the lug 1550 itself.

Figure 25:
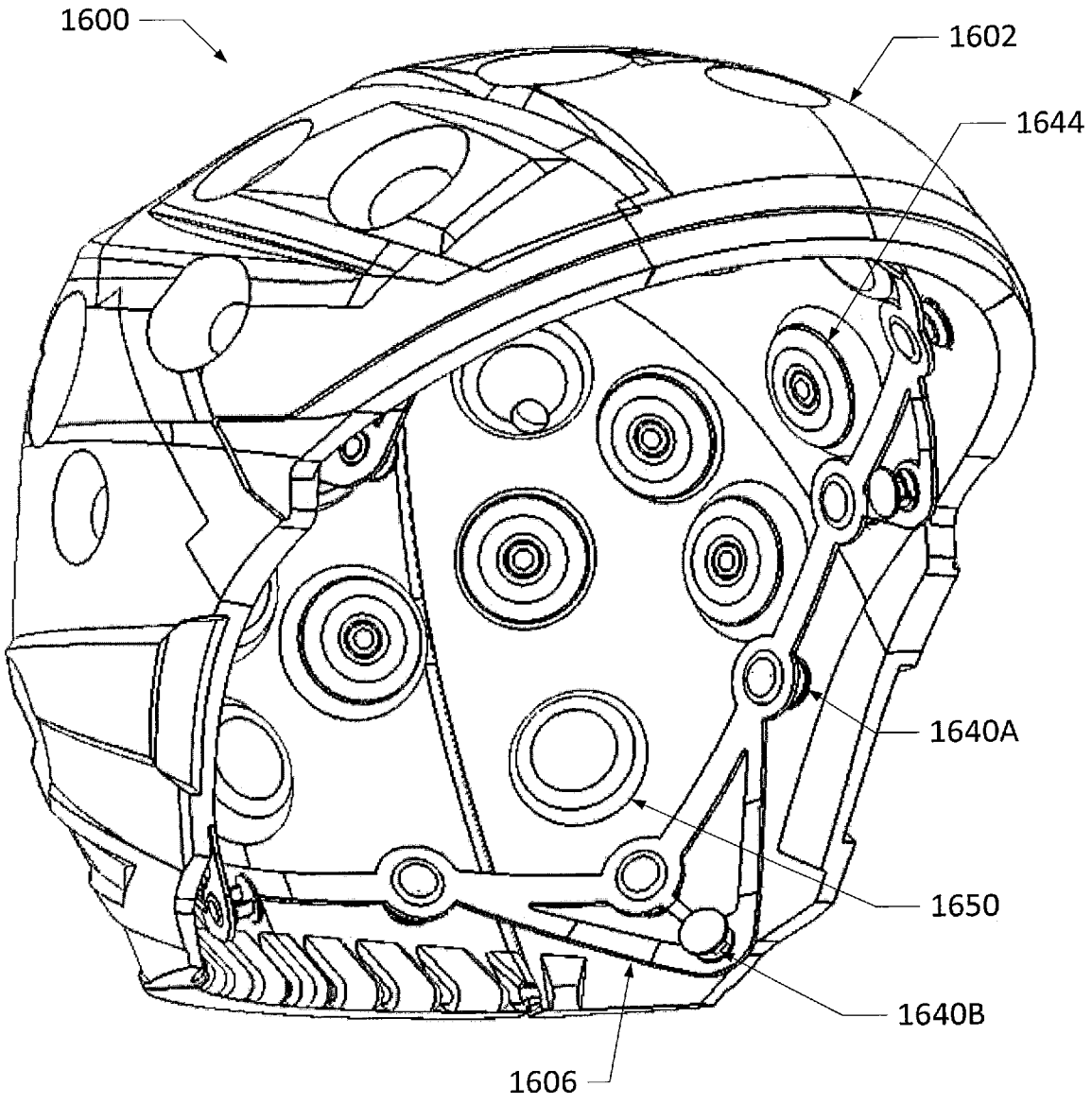
FIGS. 25 and 26 illustrate components of the helmet utilizing the impact absorbing system of FIG. 24 in accordance with an embodiment.
Figure 26:
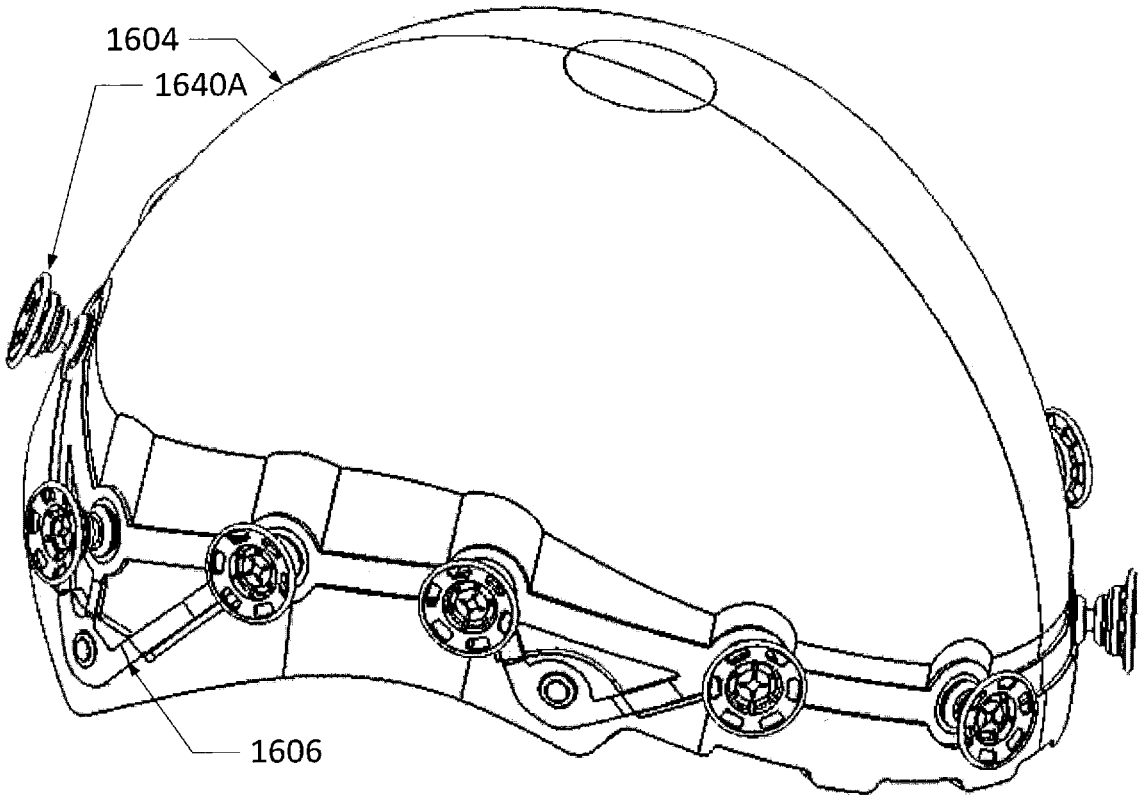

FIGS. 25-26 illustrate components of the helmet utilizing the impact absorbing system of FIG. 24 in accordance with an embodiment. Helmet 1600 illustrated in FIGS. 25-26 may be a further embodiment of the helmets 1400 and 1500 described herein. Helmet 1600 may include an outer liner 1602, an inner liner 1604, a substrate 1606, attachment damper 1640A and snap base 1640B, lug 1650, and sliding disc 1644.

The substrate 1606 of FIGS. 25-26 may couple to the outer liner 1602 and/or the inner liner 1604 along an edge of the outer liner 1602 and/or the inner liner 1604. The substrate 1606 may include a plurality of the attachment dampers 1640A and 1640B. In the embodiment shown in FIGS. 25-26, no isolation dampers may be coupled to the substrate 1606. However, the attachment dampers 1640A may be configured to couple to the outer liner 1602. The snap base 1640B may be coupled to the inner liner 1604. In certain embodiments, the snap base 1640B may be coupled to the inner liner 1604 (e.g., molded within the inner liner 1604 and/or coupled through other adhesive, mechanical, or other techniques). The snap base 1640B may be configured to receive a pin that may also be coupled to the substrate 1606. The attachment damper 1640A may be coupled to the substrate 1606 and thus the attachment dampers 1640, the snap base 1640B, the substrate 1606, and any pins may position the outer liner 1602 relative to the inner liner 1604 (and vice versa).

In the embodiment shown in FIGS. 25-26, certain lugs 1650 may include a sliding disc 1644 coupled to the lugs 1650. Other lugs 1650 may not include sliding discs 1644. Though some lugs 1650 may include sliding discs 1644 while others may not, both sliding disc 1644 equipped lugs 1650 and non-sliding disc equipped lugs 1650 may be configured to slide on the inner liner 1604.

Figure 27:
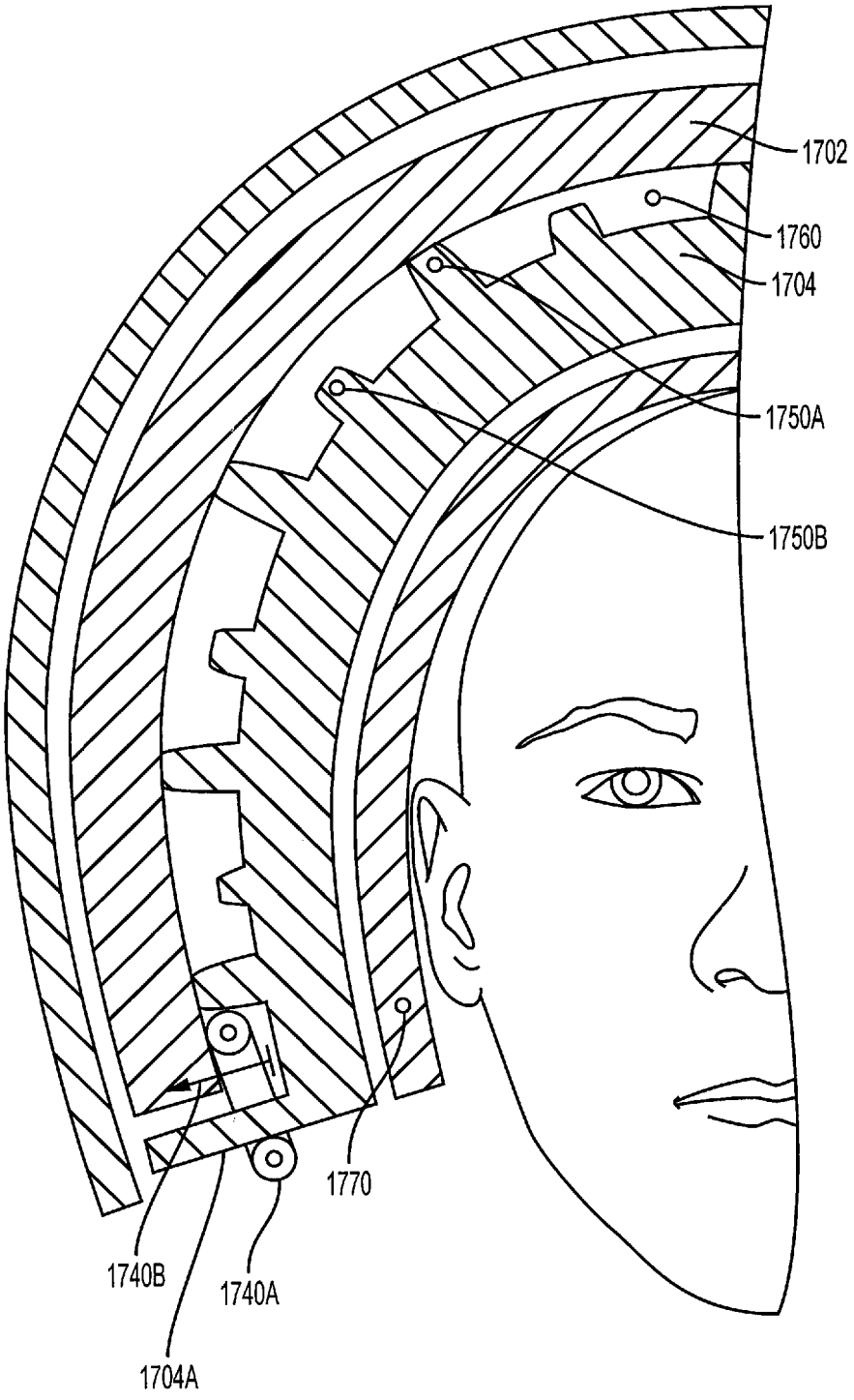
FIGS. 27 and 28 illustrate another impact absorbing system in accordance with an embodiment.
Figure 28:
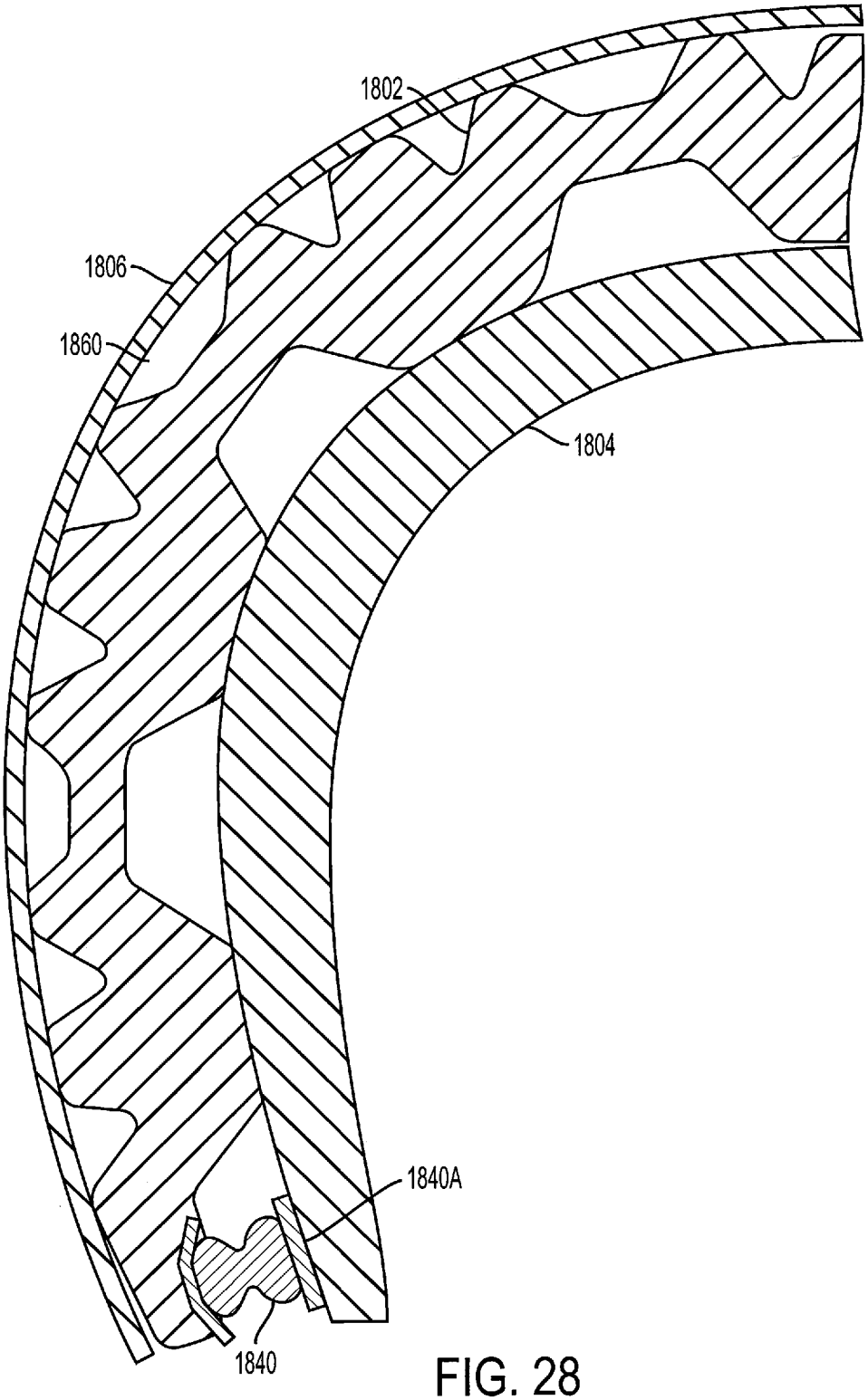

FIGS. 27-28 illustrate another impact absorbing system in accordance with an embodiment. FIG. 27 may illustrate lugs 1750A and 1750B. Lugs 1750A and 1750B may be a part of the inner liner 1704. Lugs 1750A may be configured to normally contact the outer liner 1702 while lugs 1750B may be configured to contact the outer liner 1702 only during an impact after deformation of the inner liner 1704 and/or the outer liner 1702. In certain embodiments, an opening 1760 may be disposed between the outer liner 1702 and the inner liner 1704. The opening 1760 may allow for the outer liner 1702 and/or the inner liner 1704 to deform. As such, in such embodiments, the opening 1760 may be an air gap. In certain embodiments, the opening 1760 may be filled with one or more shock absorbing materials and/or components. The shock absorbing material may be Newtonian or non-Newtonian.

FIG. 27 may also include band 1740A and pin 1740B. The band 1740A may be an elastic band coupled to a portion of the inner liner 1704 (e.g., the portion 1704A) and may be coupled to the pin 1740B. The pin 1740B may be coupled to the outer liner 1702. The band 1740A and the pin 1740B may aid in positioning of the outer liner 1702 relative to the inner liner 1704. In certain embodiments, the band 1740A may be coupled to both the inner liner 1704 and the outer liner 1702. Certain such embodiments, may not include a pin.

The embodiment of FIG. 27 the inner liner 1704 may be a removable liner. In such embodiments, the removable liner may be a soft liner that may be configured to absorb the majority of force of certain impacts. As such, the removable liner may be sacrificial and may be replaced after such impacts and may prevent damage to other parts of the helmet 1700. In certain embodiments, the removable liner may be non-destructively decoupled from other components of the helmet (e.g., the other parts of the helmet may not be damaged during removal of the removable liner). In certain embodiments, the inner liner 1704, the outer liner 1702, and/or a liner 1770 may be such a removable and/or sacrificial liner.

FIG. 28 may illustrate an embodiment with an outer shell 1806, an inner liner 1804, an outer liner 1802, an attachment damper 1840, and a substrate 1840A. The outer liner 1802 may include lugs. In the embodiment shown in FIG. 28, the outer liner 1802 may include lugs facing and configured to slide on both the outer shell 1806 and the inner liner 1804. In certain such embodiments, various lugs may be configured to engage and/or absorb impacts at various impact velocities or deflection rates. Certain other embodiments may include isolation dampers that may face both the outer shell 1806 and the inner liner 1804 alternative to or in addition to the lugs.

Additionally, the substrate 1840A may be disposed between the inner liner 1804 and the outer liner 1802. The substrate 1840A may be coupled to or inserted into a feature of the inner liner 1804 and/or the outer liner 1802. In certain embodiments, the substrate 1840A may be coupled to the inner liner 1804 and/or the outer liner 1802 without adhesives (e.g., through a mechanical fastener, molded-in, and/or through a friction fit or insertion into an opening that may then hold the substrate 1840A). Additionally, the substrate 1840A may be configured to receive the attachment damper 1840 via features such as a friction fit or mechanical fasteners. The attachment damper 1840 may couple the inner liner 1804 and/or the outer liner 1802 to position the inner liner 1804 relative to the outer liner 1802. The embodiment shown in FIG. 28 may allow for coupling of the inner liner 1804 relative to the outer liner 1804 without the use of adhesives.

Figure 29:
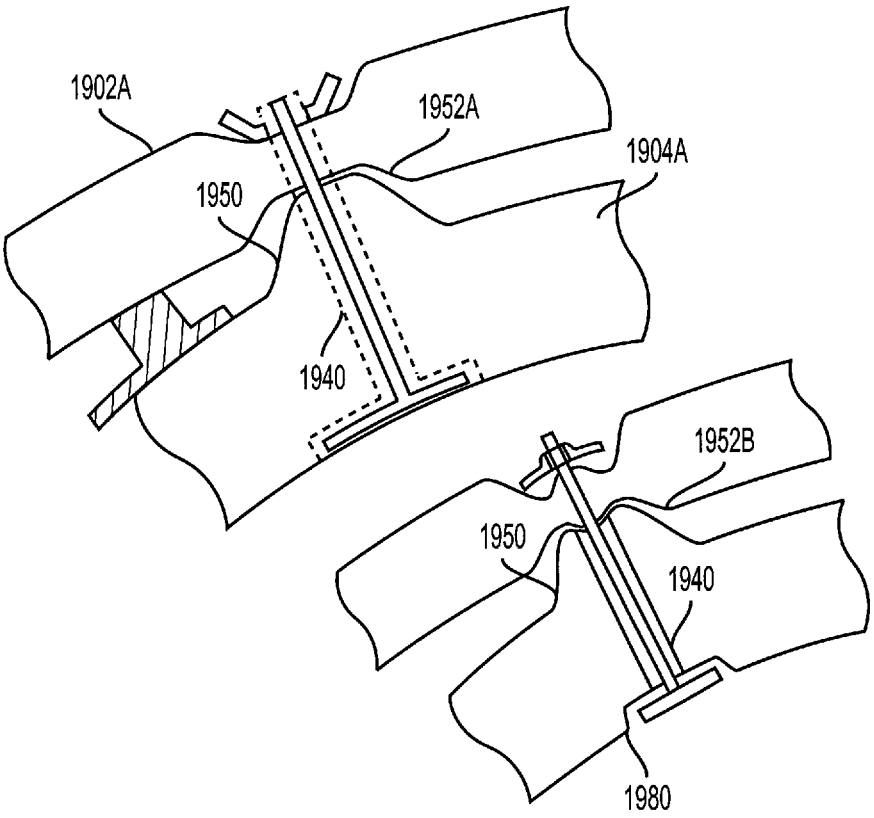
FIGS. 29 through 31 illustrate various features of certain embodiments of an impact absorbing system in accordance with an embodiment.
Figure 30:
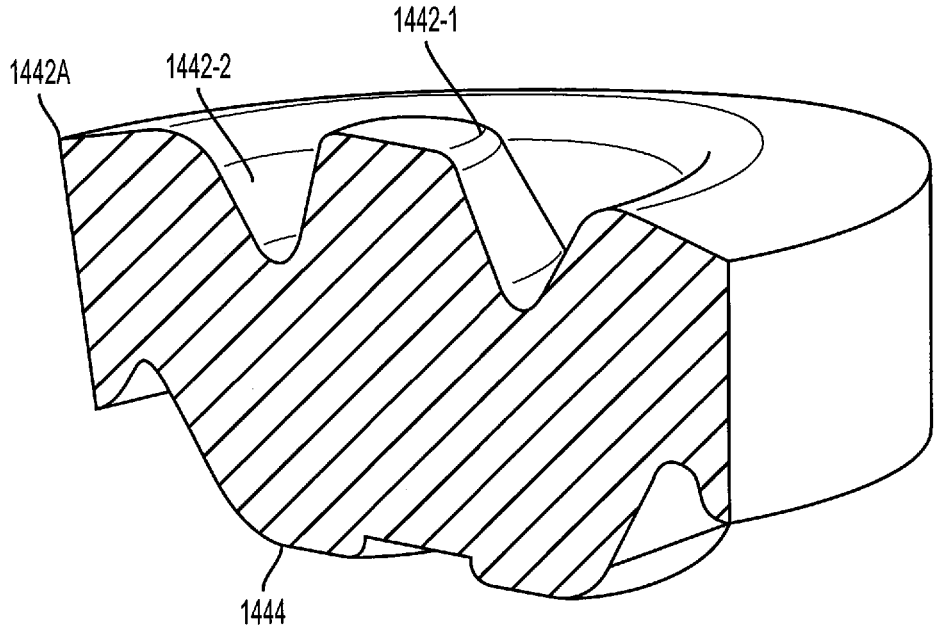
Figure 30:
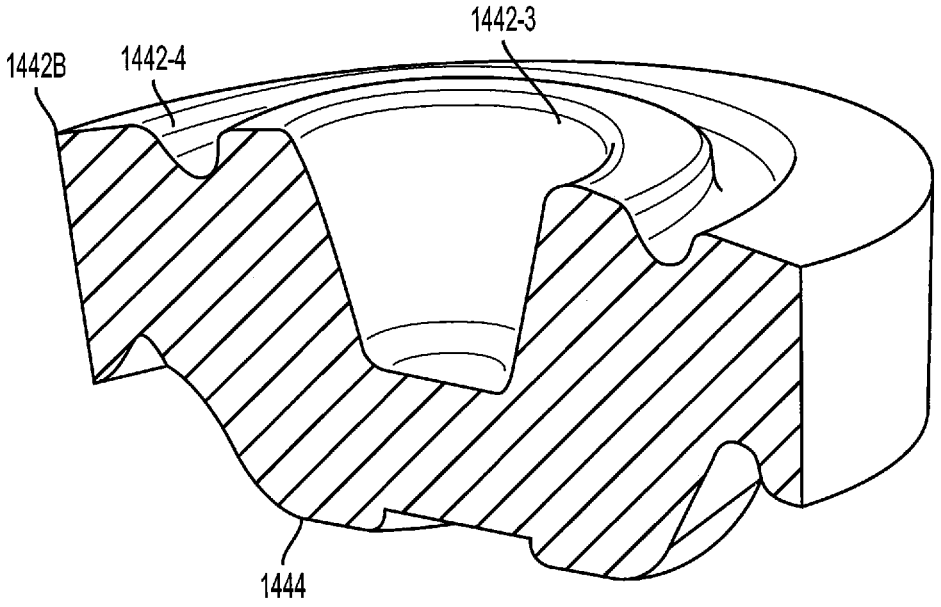
Figure 31:
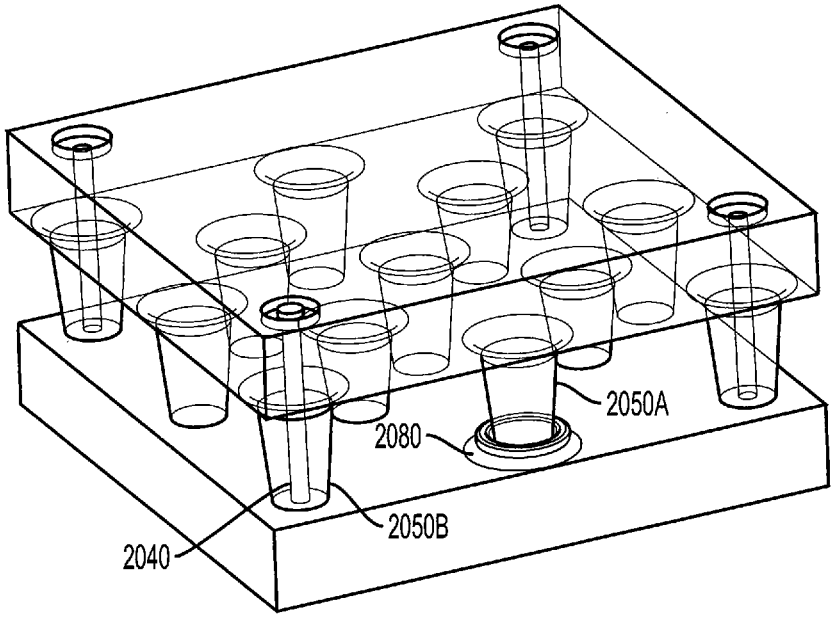
Figure 31:
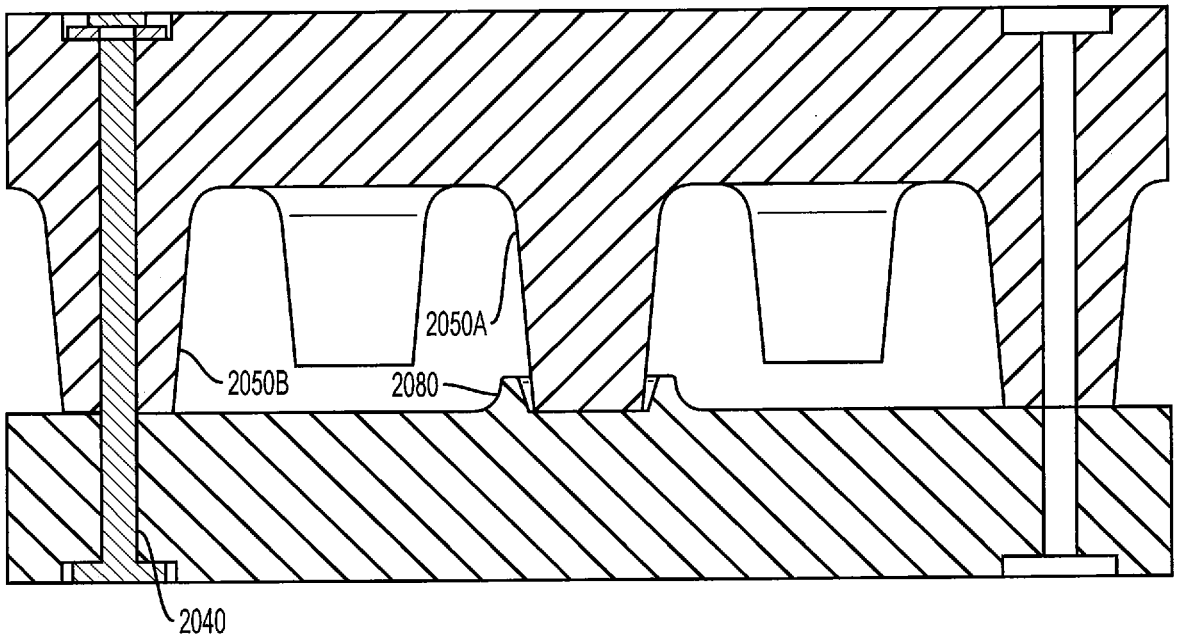

FIGS. 29-31 illustrate various features of certain embodiments of an impact absorbing system in accordance with an embodiment. FIG. 29 may illustrate two different embodiments of band 1940. The band 1940 may be, for example, an elastic cord. In the first embodiment, the band 1940 may be inserted into a receptacle of the inner liner at one end. The receptacle may hold the band 1940 via a friction fit or features of the inner liner (e.g., openings that may encase the band 1940). The other end of the band 1940 may be coupled to the outer liner via a mechanical cap. In the other embodiment, the first end of the band 1940 may be received by a feature of the inner liner so that a portion of the band 1940 is flush or below a surface of the inner liner. In embodiments where the band 1940 is an elastic cord, elasticity of the band 1940 may allow for movement of the inner liner 1904A relative to the outer liner 1902A from a first position while still returning the inner liner 1904A and the outer liner 1902A to the first position. As such, the band 1940 may allow for greater deflection of the inner liner 1904A relative to the outer liner 1902A during an impact while still retaining the ability to return the liners 1902A and 1904B back to their original positions.

FIG. 30 may illustrate additional embodiments of the isolation damper 1442. The isolation damper 1442A may include a cone 1442-1, a recess 1442-2, and a sliding disc 1444. The cone 1442-1 may be configured to contact an inner liner and/or an outer liner. The geometry of the cone 1442-1 may be determined according to the rate desired for the isolation damper 1442A. In certain embodiments, the cone 1442-1 may allow for the isolation damper 1442A to be variable rate. In various embodiments, the recess 1442-2 may or may not be filled with an additional material. Certain such materials may include impact absorbing properties that are different from that of the isolation damper 1442.

The isolation damper 1442B may include a first recess 1442-3, a second recess 1442-4, and a sliding disc 1444. One or both of the first recess 1442-3 and the second recess 1442-4 may be filled or partially filled with an additional material. The additional material may include properties similar to or different from that of the main portion of the isolation damper 1442B. In certain embodiments may include additional recesses that may also be filled with materials of different properties. Additionally, while FIG. 30 illustrates isolation dampers with cones and recesses, other embodiments may include, for example, lugs and/or liners with such cones and recesses.

FIG. 31 may illustrate cutaway view and an isometric see-through view of a first liner that may include a lug 2050A that may be configured to be disposed between locating features 2080 of a second liner. The locating features 2080 may aid in positioning the inner liner relative to the outer liner. The locating features 2080 may, for example, hold the lug 2050A within a certain area. Additionally, the lug 2050B may include a feature to allow the band 2040 to pass through the lug 2050B. The band 2040 may aid in positioning the inner liner relative to the outer liner. In certain embodiments, the band 2040 may be an elastic band and may include a molded head (e.g., molded into a liner) at one end and a mechanical head at another end.

Figure 32:
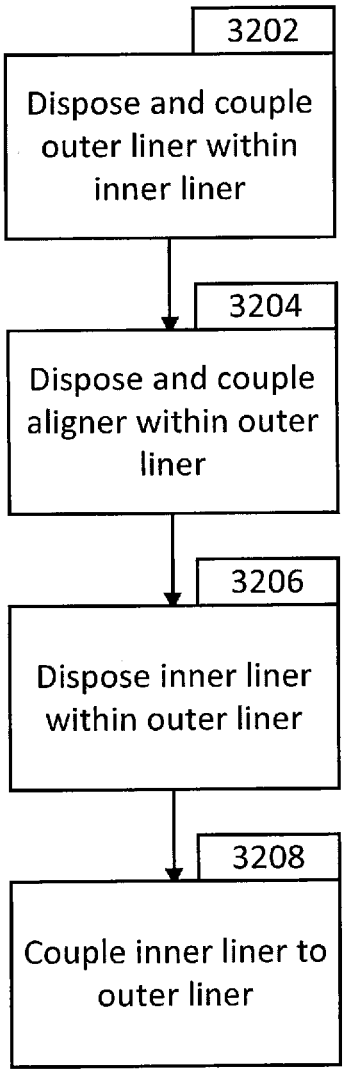
FIG. 32 is a flowchart detailing an assembly process of a helmet in accordance with an embodiment.

FIG. 32 is a flowchart detailing an assembly process of a helmet in accordance with an embodiment. In block 3202, an outer liner may be disposed within an outer shell. The outer liner may then be coupled to the outer shell via, for example, bonding, adhesives, mechanical fasteners, mold-in, or other techniques. In certain embodiments, the outer liner may be molded within the outer shell and thus disposing and coupling the outer liner to the outer shell may occur substantially simultaneously.

In block 3204, an aligner may be disposed within and coupled to the outer liner. The aligner may be coupled to the outer liner via, for example, bonding, adhesives, mechanical fasteners, mold-in, or other techniques described herein. In certain embodiments the aligner may be molded into the outer liner.

In block 3206, an inner liner may be disposed within the outer liner. The inner liner may then be coupled to the aligner in block 3208 so that the outer liner, the aligner, and the inner liner may be coupled. Coupling may be via, for example, bonding, adhesives, mechanical fasteners, mold-in, or other techniques described herein. In certain such embodiments, the aligner may control the distance between portions of the outer liner and portions of the inner liner and may be configured to allow the distance to change upon receiving an impact. In certain embodiments, the inner liner, the outer liner, the aligner, and/or another components may include one or more isolation dampers and/or lugs. In embodiments where another component includes one or more isolation dampers and/or lugs, such a component may also be disposed within and/or coupled to the outer shell, the outer liner, and/or the inner liner.

Other embodiments of the impact absorbing system may include any of the impact absorbing system configurations detailed herein in various safety helmets (e.g., sports helmets, construction helmets, racing helmets, helmets worn by armed forces personnel, helmets for the protection of people such as toddlers, bicycle helmets, pilot helmets, and other helmets) as well as in various other safety equipment designed to protect a wearer. Non-limiting examples of such other safety equipment may include body armor such as vests, jackets, and full body suits, gloves, elbow pads, shin pads, hip pads, shoes, helmet protection equipment, and knee pads.

By using different materials and configurations, it is possible to adjust or tune the protection provided by helmets that use the systems of the disclosure, as would be understood by one skilled in the art. The liners and any other layers can be formed from materials with distinct flexibility, compression, and crush characteristics, and the isolation dampers can be formed from various types of elastomers or other appropriate energy absorbing materials, such as MCU. Thus, by controlling the density and stiffness of the isolation dampers and related internal constructional materials, safety helmets can be configured to strategically manage impact energy based on the known range of common head weights expected to be present in any given helmet, and by helmet size, and by any give sporting activity.

The foregoing description is presented so as to enable any person skilled in the art to make and use the invention. For purposes of explication, specific nomenclature has been set forth to provide a thorough understanding of the disclosure. However, it should be understood that the descriptions of specific embodiments or applications provided herein are provided only by way of some example embodiments of the invention and not by way of any limitations thereof. Indeed, various modifications to the embodiments will be readily apparent to those skilled in the art, and the general principles defined herein can be applied to other embodiments and applications without departing from the spirit and scope of the invention. Thus, the present invention should not be limited to the particular embodiments illustrated and described herein, but should be accorded the widest possible scope consistent with the principles and features disclosed herein.

What is claimed is:

1. A helmet comprising:

an outer shell;

a liner assembly comprising:

an outer liner disposed within and coupled to the outer shell; and an inner liner disposed within and coupled to the outer liner; and a limit mechanism disposed on the liner assembly and configured to prevent over-rotation and/or over-displacement between the outer liner and the inner liner, wherein the limit mechanism comprises a protrusion that forms an integral part of one of the outer liner or the inner liner and is of the same material as the one of the outer liner or the inner liner, and wherein the protrusion extends from a surface of the one of the outer liner or the inner liner.

2. The helmet of claim 1, wherein the protrusion comprises a lug that forms the integral part of, is of the same material as, and extends from the surface of the one of the outer liner or the inner liner, wherein the lug is disposed within an air gap separating the inner liner and the outer liner such that the lug is surrounded by air when the helmet is in a resting position, and wherein the protrusion and the one of the outer liner or the inner liner are a single unified piece manufactured from the same mold.

3. The helmet of claim 1, wherein the protrusion engages with a corresponding recess of the other of the inner liner or the outer liner.

4. The helmet of claim 1, wherein the protrusion forms an integral part of, is of the same material as, and extends from an outer surface of the inner liner to prevent over-rotation and/or over-displacement between the outer liner and the inner liner.

5. The helmet of claim 1, wherein the protrusion forms an integral part of, is of the same material as, and extends from an inner surface of the outer liner to prevent over-rotation and/or over-displacement between the outer liner and the inner liner.

6. The helmet of claim 1, further comprising a second limit mechanism comprising a flange.

7. The helmet of claim 1, wherein the liner assembly further comprises a side liner configured to be disposed adjacent a wearer's jaw, and wherein the outer liner and/or the inner liner are configured to be movable relative to the side liner.

8. The helmet of claim 7, further comprising a second limit mechanism disposed on the side liner and configured to prevent over-rotation and/or over-displacement between the outer liner and the inner liner.

9. The helmet of claim 1, further comprising an aligner coupled to the inner liner and the outer liner and configured to position the outer liner relative to the inner liner.

10. The helmet of claim 9, wherein the aligner is further coupled to the limit mechanism.

11. The helmet of claim 9, wherein at least a portion of the aligner is disposed between an outer surface of the inner liner and an inner surface of the outer liner.

12. The helmet of claim 9, further comprising a pin coupled to the outer liner and the aligner, and wherein the aligner and the pin are collectively configured to position the outer liner relative to the inner liner.

13. The helmet of claim 9, further comprising a substrate disposed between the outer liner and the inner liner, and wherein the aligner is coupled to one or both of the outer liner or the inner liner via the substrate.

14. The helmet of claim 13, wherein the substrate is configured to slide on the outer liner or the inner liner.

15. The helmet of claim 9, wherein the aligner comprises a band.

16. The helmet of claim 1, further comprising a second limit mechanism comprising a gap between the inner liner and the outer liner configured to have a shape conforming to a wearer's head and to bind during rotation due to contact of impingement points.

17. The helmet of claim 1, wherein the liner assembly further comprises a removable liner having a surface facing the inner liner and, when the helmet is worn by a wearer, a surface facing the wearer's head.

18. A method of assembling a helmet comprising:

an outer shell;

a liner assembly comprising:

an outer liner disposed within and coupled to the outer shell; and an inner liner disposed within and coupled to the outer liner; and a limit mechanism disposed on the liner assembly and configured to prevent over-rotation and/or over-displacement between the outer liner and the inner liner, wherein the limit mechanism comprises a protrusion that forms an integral part of one of the outer liner or the inner liner and is of the same material as the one of the outer liner or the inner liner, and wherein the protrusion extends from a surface of the one of the outer liner or the inner liner;

the method comprising:

disposing and coupling the outer liner within the outer shell;

disposing the inner liner within the outer liner;

disposing the limit mechanism on the inner liner or the outer liner; and coupling an aligner to the outer liner and the inner liner.

19. A method of servicing a helmet comprising:

an outer shell;

a liner assembly comprising:

an outer liner disposed within and coupled to the outer shell; and an inner liner disposed within and coupled to the outer liner; and a limit mechanism disposed on the liner assembly and configured to prevent over-rotation and/or over-displacement between the outer liner and the inner liner, wherein the limit mechanism comprises a protrusion that forms an integral part of one of the outer liner or the inner liner and is of the same material as the one of the outer liner or the inner liner, and wherein the protrusion extends from a surface of the one of the outer liner or the inner liner;

the method comprising:

decoupling a removable liner of the helmet, wherein the removable liner comprises the inner liner or the outer liner;

disposing an undamaged removable liner; and coupling the undamaged removable liner to the helmet.

20. The helmet of claim 1, wherein the protrusion forms an integral part of the outer liner and is of the same material as the outer liner, and wherein the protrusion extends from an end of an edge of an inner surface of the outer liner to prevent over-rotation and/or over-displacement between the outer liner and the inner liner.

* * * * *